US007365685B2

(12) United States Patent
Takeuchi et al.

(10) Patent No.: US 7,365,685 B2
(45) Date of Patent: Apr. 29, 2008

(54) ANTENNA DEVICE

(75) Inventors: Shoichi Takeuchi, Aiko-gun (JP); Hiroyuki Hayakawa, Aiko-gun (JP); Koichi Osada, Aiko-gun (JP); Ryuta Sonoda, Aiko-gun (JP)

(73) Assignee: Asahi Glass Company, Limited, Tokyo (JP)

( * ) Notice: Subject to any disclaimer, the term of this patent is extended or adjusted under 35 U.S.C. 154(b) by 92 days.

(21) Appl. No.: 11/256,050

(22) Filed: Oct. 24, 2005

(65) Prior Publication Data

US 2006/0109178 A1 May 25, 2006

Related U.S. Application Data

(63) Continuation of application No. PCT/JP2004/005880, filed on Apr. 23, 2004.

(30) Foreign Application Priority Data

Apr. 24, 2003 (JP) ..... 2003-119944
Aug. 1, 2003 (JP) ..... 2003-285224
Mar. 9, 2004 (JP) ..... 2004-065647

(51) Int. Cl.
*H01Q 1/38* (2006.01)

(52) U.S. Cl. ..... 343/700 MS; 343/713

(58) Field of Classification Search ..... 343/700 MS, 343/711, 713, 846

See application file for complete search history.

(56) References Cited

U.S. PATENT DOCUMENTS 4,994,820 A 2/1991 Suzuki et al.
5,355,143 A * 10/1994 Zurcher et al. ..... 343/700 MS
5,757,327 A * 5/1998 Yajima et al. ..... 343/713
5,760,744 A 6/1998 Sauer
5,880,694 A * 3/1999 Wang et al. ..... 343/700 MS
5,977,915 A * 11/1999 Bergstedt et al. .... 343/700 MS
6,164,984 A 12/2000 Schreiner
6,307,515 B1 10/2001 Sauer et al.
6,342,856 B1 1/2002 Nakano et al.
6,593,887 B2 7/2003 Luk et al.

(Continued)

FOREIGN PATENT DOCUMENTS

EP 1 091 444 A2 4/2001

(Continued)

OTHER PUBLICATIONS

Girish Kumar, et al., Broadband Microstrip Antennas, Artech House, Inc., 2003, pp. 4 to 7, 60 to 63 and 130-139.

(Continued)

*Primary Examiner*—Tan Ho
(74) *Attorney, Agent, or Firm*—Oblon, Spivak, McClelland, Maier & Neustadt, P.C.

(57) ABSTRACT

A antenna device, which includes a first dielectric substrate having a patch conductor disposed thereon; a second dielectric substrate having a grounding conductor disposed on a confronting substrate surface confronting the patch conductor; and a conductor for electromagnetic coupling, extending from the confronting substrate surface of the second dielectric substrate toward the first dielectric substrate, is provided. The antenna device is small and is capable of being mounted to a windowpane for a vehicle since the conductor for electromagnetic coupling is not connected to the grounding conductor with respect to a direct current and since the conductor for electromagnetic coupling and the patch conductor are electromagnetically coupled each other.

67 Claims, 14 Drawing Sheets

U.S. PATENT DOCUMENTS

| | | | | |
|---|---|---|---|---|
| 6,924,774 | B2 * | 8/2005 | Komatsu et al. | 343/767 |
| 7,050,006 | B2 * | 5/2006 | Jan et al. | 343/700 MS |
| 7,091,907 | B2 * | 8/2006 | Brachat | 343/700 MS |
| 2004/0239571 | A1 * | 12/2004 | Papziner et al. | 343/713 |

FOREIGN PATENT DOCUMENTS

| | | | |
|---|---|---|---|
| EP | 1 280 224 | A1 | 1/2003 |
| JP | 54-85954 | | 11/1952 |
| JP | 61-290803 | | 12/1986 |
| JP | 63-95308 | | 6/1988 |
| JP | 2-108307 | | 4/1990 |
| JP | 2-162804 | | 6/1990 |
| JP | 2-184101 | | 7/1990 |
| JP | 4-170803 | | 6/1992 |
| JP | 5-63423 | | 3/1993 |
| JP | 5-145327 | | 6/1993 |
| JP | 5-145329 | | 6/1993 |
| JP | 5-191124 | | 7/1993 |
| JP | 6-13814 | | 1/1994 |
| JP | 6-38317 | | 5/1994 |
| JP | 7-30316 | | 1/1995 |
| JP | 8-250917 | | 9/1996 |
| JP | 8-265038 | | 10/1996 |
| JP | 9-153730 | | 6/1997 |
| JP | 9-247081 | | 9/1997 |
| JP | 10-200317 | | 7/1998 |
| JP | 11-234016 | | 8/1999 |
| JP | 11-330849 | | 11/1999 |
| JP | 2000-151267 | | 5/2000 |
| JP | 2000-183631 | | 6/2000 |
| JP | 2001-143531 | | 5/2001 |
| JP | 3239561 | | 10/2001 |
| JP | 2001-339239 | | 12/2001 |
| JP | 2002-518920 | | 6/2002 |
| JP | 2002-237714 | | 8/2002 |
| JP | 2002-246817 | | 8/2002 |
| JP | 2002-252520 | | 9/2002 |
| JP | 2002-271131 | | 9/2002 |
| JP | 2002-344100 | | 11/2002 |
| JP | 2003-46324 | | 2/2003 |
| JP | 2003-60429 | | 2/2003 |

OTHER PUBLICATIONS

K.M. Luk, et al., "Broadband microstrip patch antenna", Electronics Letters, vol. 34, No. 15, Jul. 23, 1998, pp. 1442-1443.

Misao Haneishi, et al., "A Design Method of Circularly Polarized Rectangular Microstrip Antenna by One-Point Feed", The Institute of Electronics, Information and Communication Engineers, vol. J64-B, No. 4, pp. 225-231.

C. L. Mak, et al., "Broadband patch antenna with a T-shaped probe", IEE Proc.-Microw. Antennas Progag., vol. 147, No. 2, Apr. 2000, pp. 73-76.

* cited by examiner

ANTENNA DEVICE

TECHNICAL FIELD

The present invention relates to an antenna device suitable for communication using a frequency in GHz, in particular to an antenna device applicable to a glass antenna for a vehicle.

BACKGROUND ART

For recent years, GPS (Global Positioning System), VICS (Vehicle Information and Communication System), ETC (Electric Toll Collection System) and others have been utilized for smooth running of a vehicle by performing communication using a radio wave between in-vehicle communication equipment and external communication equipment.

As an example of the antenna of such in-vehicle communication equipment used in these systems, an attempt has been made to affix an antenna device on the front windshield of a vehicle, the antenna device including a microstrip antenna (hereinbelow, referred to as MSA). However, transmitted power or received power is deceased since, e.g., reflection of a radio wave is generated by the front windshield because of communication with external communication equipment through the front windshield. Specifically, there has been a problem that a portion of the radio wave radiated from an MSA is reflected on an interface of the front windshield to generate a reflected wave, and that the reflected wave interferes with a radiated wave from the MSA to reduce the gain of the antenna device.

In the prior art, it has been possible to prevent the gain of an MSA from being reduced by using a positioning spacer to limit the position of the MSA and disposing the MSA in the vicinity of a position apart from a front windshield by a distance of an integral multiple of a reference length, the reference length being a length obtained by multiplying the wavelength of a half of the wavelength of a radiated radio wave by a correction constant, as disclosed in JP-A-2002-246817.

JP-A-2002-252520 has disclosed a planar antenna, which has a patch conductor and a grounding conductor disposed only on a single surface of a dielectric substrate. In this planar antenna, the patch conductor is disposed in a certain pattern on the single surface of the dielectric substrate, and the grounding conductor is disposed around the patch conductor, having a certain gap (slot) interposed between both conductors. This planar antenna is called a coplanar patch antenna (hereinbelow, referred to as CPA).

JP-A-5-63423 has disclosed a planar antenna, wherein a conductor layer for a radiating element, a dielectric layer and a grounding conductor layer are disposed on at least one portion of a windowpane for a vehicle in this order from the bottom as "a planar antenna for a vehicle", and wherein the conductor layer is connected to an input terminal of an amplifier disposed in the vicinity of the antenna. This planar antenna is fabricated by using silver paste for the conductor layer for a radiating element and the grounding conductor layer, using a dielectric material, such as glass, a resin or a ceramic material, for the dielectric layer, printing each of the paste and the dielectric material as a thick film and baking the printed films.

However, the fabricating process is complicated since it is necessary to repeat printing and drying when a multilayer is applied as a thick film to a windowpane by printing. When printing for each of the layers is successfully performed, huge equipment is needed since a printer and a dryer are needed for fabrication of each of the layers. Additionally, it is difficult to simultaneously bake the respective layers in a sufficient manner in a case where the respective layers are printed in a multilayered structure so as to have a shape optimum for a windowpane for a vehicle. Although it is disclosed that a metal plate-like material, a sheet-like material or a film-like material is bonded by an adhesive, antenna characteristics are different from desired characteristics because of the presence of an adhesive layer.

Although it is described that the respective layers can be laminated so as to have a total thickness of hundreds of μm or below, it is difficult to have a resonant structure and to increase radiating efficiency in a microstrip antenna structure when the dielectric layer is too thinner than the wavelength of a radio wave. When an attempt is made to increase the dielectric constant of the dielectric layer and to make the dielectric layer thinner, there has been caused a problem that since an increase in the dielectric constant generally increases dielectric loss, the radiating efficiency as an antenna decreases, and the bandwidth is made narrower, with the result that the antenna device is not suitable for receiving a feeble radio wave from, e.g., an artificial satellite.

JP-A-2002-237714 has disclosed in FIG. 6 a patch antenna device, wherein spacers are disposed on a substrate with a grounding conductor disposed thereon, and wherein a patch conductor made of a metal plate in a square shape is supported by the spacers. In this prior art, the patch conductor is not disposed on a dielectric substrate. This causes a problem in that it is difficult to mount the antenna device when the antenna device is applied to a vehicle or the like.

JP-A-8-265038 has disclosed in FIG. 8 an annular microstrip antenna, wherein an island-like conductor is disposed inside an annular patch conductor disposed on one of the surfaces of a dielectric substrate for performing impedance matching. In this prior art, a grounding conductor is disposed on the other surface of the dielectric substrate, and a center conductor of a coaxial cable is passed through a hole formed in each of the dielectric substrate and the grounding conductor, and a leading edge of the center conductor is connected to the island-like conductor. This causes a problem in that it is difficult to mount the antenna device when the antenna device is applied to a vehicle or the like.

U.S. Pat. No. 6,593,887 has disclosed in FIG. 2 and the like a patch antenna, wherein a patch conductor and a grounding conductor are disposed so as to be apart from each other, and wherein a conductor for electromagnetic coupling is disposed so as to extend toward the patch conductor, passing through a hole formed in the grounding conductor. However, this prior art fails to disclose a specific structure as an antenna device as a whole. This causes a problem in that a mounting means is vague in terms of application of the antenna device on a vehicle or the like.

When an antenna device including the above-mentioned MSA is affixed to a front windshield, the MSA needs to be disposed in the vicinity of a position apart from the front windshield by a distance of an integral multiple of a reference length, the reference length being a length obtained by multiplying the wavelength of a half of the wavelength of a radiated radio wave by a correction constant, as stated earlier.

Accordingly, a dielectric substrate with the MSA disposed thereon and the front windshield need to have a thick gap interposed therebetween. This causes problems in that the thickness of the antenna device with the MSA increases, that a driver, who drives a vehicle with the antenna device mounted thereto, is given bad visibility by the antenna, and additionally that the antenna is not preferable in terms of interior design.

The CPA disclosed in JP-A-2002-252520 can be easily disposed on a front windshield, a backlite or the like since the antenna element comprises a conductor disposed on one of the surfaces of a dielectric substrate. However, it is necessary to use a connector for deriving a received signal from the CPA disposed on the front windshield or the backlite, and to directly solder a coaxial cable, for example. This causes a problem in that the antenna is not necessarily practical in terms of manufacturing efficiency and cost.

When a CPA is mounted to a vehicle for communication with an external communication equipment, the antenna has directivities in two directions of both surfaces of a dielectric substrate. This causes a problem in that a signal cannot be always transmitted or received with good efficiency. From the viewpoint of the problems stated above, it have been demanded to provide an antenna device for a high frequency band, which is made smaller, thinner, more efficient and more inexpensive than the conventional antenna devices.

DISCLOSURE OF THE INVENTION

The present invention provides an antenna device comprising:

a first dielectric substrate having a patch conductor disposed thereon; and a second dielectric substrate confronting the first dielectric substrate and having a grounding conductor disposed on a substrate surface confronting the patch conductor;

wherein the second dielectric substrate is disposed on a spacer disposed on the first dielectric substrate; and the second dielectric substrate and the first dielectric substrate are separated from each other by a distance by the spacer, the space being interposed between the second dielectric substrate and the first dielectric substrate.

The present invention also provides an antenna device having a microstrip antenna, comprising a patch conductor, a second dielectric substrate and a grounding conductor, the patch conductor being disposed on an interior surface of a windowpane for a vehicle as a first dielectric substrate or an a dielectric film disposed on an interior surface of a windowpane for a vehicle as a first dielectric substrate, the second dielectric substrate being disposed so as to be apart from the windowpane by a distance so as to confront the patch conductor, and the grounding conductor being disposed on the second dielectric substrate;

wherein when a radio wave to be used in communication has a wavelength of $\lambda_0$ in air, and when a shortest distance between the patch conductor and an edge of an opening of a vehicle body is D, the formula of $0.01 \leqq D/\lambda_0$ is established; and wherein a shortest distance between a portion of the antenna device farthest from the edge of the opening of the vehicle body and the edge of the opening of the vehicle body is 200 mm or below.

The present invention also provides an antenna device having a microstrip antenna, comprising a patch conductor, an insulating sheet or insulating substrate and a grounding conductor, the patch conductor being disposed on an interior surface of a windowpane for a vehicle as a first dielectric substrate or on a dielectric film disposed on an interior surface of a windowpane for a vehicle as a first dielectric substrate, the insulating sheet or insulating substrate being disposed on the windowpane so as to confront the patch conductor, and the grounding conductor being disposed on the insulating sheet or insulating substrate;

wherein when a radio wave to be used in communication has a wavelength of $\lambda_0$ in air, and when a shortest distance between the patch conductor and an edge of an opening of a vehicle body is D, the formula of $0.01 \leqq D/\lambda_0$ is established; and wherein a shortest distance between a portion of the antenna device farthest from the edge of the opening of the vehicle body and the edge of the opening of the vehicle body is 200 mm or below.

The present invention also provides a method for fabricating the above-mentioned antenna device comprising the steps of (1) to (5) below:

(1) preparing a windowpane as the first dielectric substrate, the windowpane being fitted into an opening of a vehicle and having the patch conductor disposed thereon, or preparing a windowpane as the first dielectric substrate, the windowpane being not fitted into an opening of a vehicle but having the patch conductor disposed thereon;

(2) disposing a bonding portion on the windowpane or disposing a bonding portion on a surface of the spacer close to the windowpane;

(3) affixing the spacer at a position on the windowpane so that the spacer is bonded to the windowpane through the bonding portion;

(4) disposing a dielectric substance on a substrate surface of the second dielectric substrate close to the windowpane, followed by fixing the second dielectric substrate to the spacer after; and (5) fitting the windowpane into the opening when using in step (1) the windowpane that is not fitted into the opening.

The present invention also provides a method comprising, instead of step (4), a step for affixing the spacer to the windowpane, followed by disposing a dielectric substance on the patch conductor and by fixing the second dielectric substrate to the spacer.

The present invention also provides a method comprising, instead of step (4), a step for fixing the second dielectric substrate to the spacer, followed by introducing a dielectric substance, through a hole formed in the spacer or the second dielectric substrate, into a gap surrounded by the windowpane and the second dielectric substrate, the dielectric substance having fluidity.

The present invention also provides a method further comprising in step (4) or the step in exchange for step (4):

providing the spacer with a first fixing means, and preparing an upper casing having a second fixing means formed therein; and fixing the second fixing means to the first fixing means so that the second dielectric substrate is sandwiched between the spacer and the upper casing and that the upper casing is mounted to the spacer so as to cover the second dielectric substrate.

The present invention also provides a method further comprising in step (4) or the step in exchange for step (4):

providing the spacer with a first fixing means, and preparing an upper casing having a second fixing means and having the second dielectric substrate disposed therein; and fixing the second fixing means to the first fixing means so that the upper casing is mounted to the spacer.

The present invention also provides a method further comprising in step (4) or the step in exchange for step (4):

providing the second dielectric substrate with a conductor for electromagnetic coupling or a pillar-like conductor.

The present invention also provides a method further comprising in step (4):

using the dielectric substance having fluidity; and disposing a molding frame on the second dielectric substrate when disposing the dielectric substance on the grounding conductor on the second dielectric substrate, and introducing the dielectric substance into the molding frame, followed by removing the molding frame after causing the dielectric substance to lose the fluidity or to slightly lose the fluidity and by fixing the second dielectric substrate to the spacer.

The present invention also provides a method for fabricating the above-mentioned antenna device, comprising the steps of (a1) to (a5) below:

(a1) preparing a windowpane as the first dielectric substrate, the windowpane being fitted into an opening of a vehicle and having the patch conductor disposed thereon, or preparing a windowpane as the first dielectric substrate, the windowpane being not fitted into an opening of a vehicle but having the patch conductor disposed thereon;

(a2) disposing a bonding portion on the windowpane or disposing a bonding portion on a surface of the spacer close to the windowpane;

(a3) fixing the second dielectric substrate to the spacer;

(a4) disposing a dielectric substance on a substrate surface of the second dielectric substrate close to the windowpane, followed by affixing the spacer at a position on the windowpane so as to bond the spacer to the windowpane through the bonding portion; and (a5) fitting the windowpane into the opening when using in step (a1) the windowpane that is not fitted into the opening.

The present invention also provides a method comprising instead of step (a4), a step for disposing a dielectric substance on the patch conductor on the windowpane, followed by fixing the spacer to the windowpane.

The present invention also provides a method, instead of step (a4), comprising a step for fixing the spacer to the windowpane, followed by introducing a dielectric substance, through a hole formed in the spacer or the second dielectric substrate, into a gap surrounded by the windowpane and the second dielectric substrate, the dielectric substance having fluidity.

The present invention also provides a method comprising, instead of step (a3):

providing the spacer with a first fixing means, and preparing an upper casing having a second fixing means; and fixing the second fixing means to the first fixing means so that the second dielectric substrate is sandwiched between the spacer and the upper casing and that the upper casing is mounted to the spacer so as to cover the second dielectric substrate.

The present invention also provides a method comprising, instead of step (a3):

providing the spacer with a first fixing means, and preparing an upper casing having a second fixing means formed therein and having the second dielectric substrate disposed therein; and fixing the second fixing means to the first fixing means so that the upper casing is mounted to the spacer.

The present invention also provides a method further comprising in step (a3) or the step in exchange for step (a4):

mounting a conductor for electromagnetic coupling or a pillar-like conductor before fixing the second dielectric substrate to the spacer or after fixing the second dielectric substrate to the spacer.

The present invention also provides a method further comprising in a step in exchange for step (a4):

using the dielectric substance having fluidity; and disposing a molding frame on the windowpane when disposing the dielectric substance on the patch conductor on the windowpane, and introducing the dielectric substance into the molding frame, followed by removing the molding frame after causing the dielectric substance to lose the fluidity or to slightly lose the fluidity and by affixing the spacer at a position on the windowpane.

The present invention also provides a method, wherein the spacer and the upper casing are integrally formed.

The radio wave used in the antenna device according to the present invention has a frequency of preferably from 300 MHz to 3 THz, more preferably from 0.8 to 60 GHz, particularly preferably from 1.0 to 30 GHz, most preferably from 1.2 to 6.38 GHz.

EXPLANATION OF THE REFERENCE NUMERALS

Figure 1:
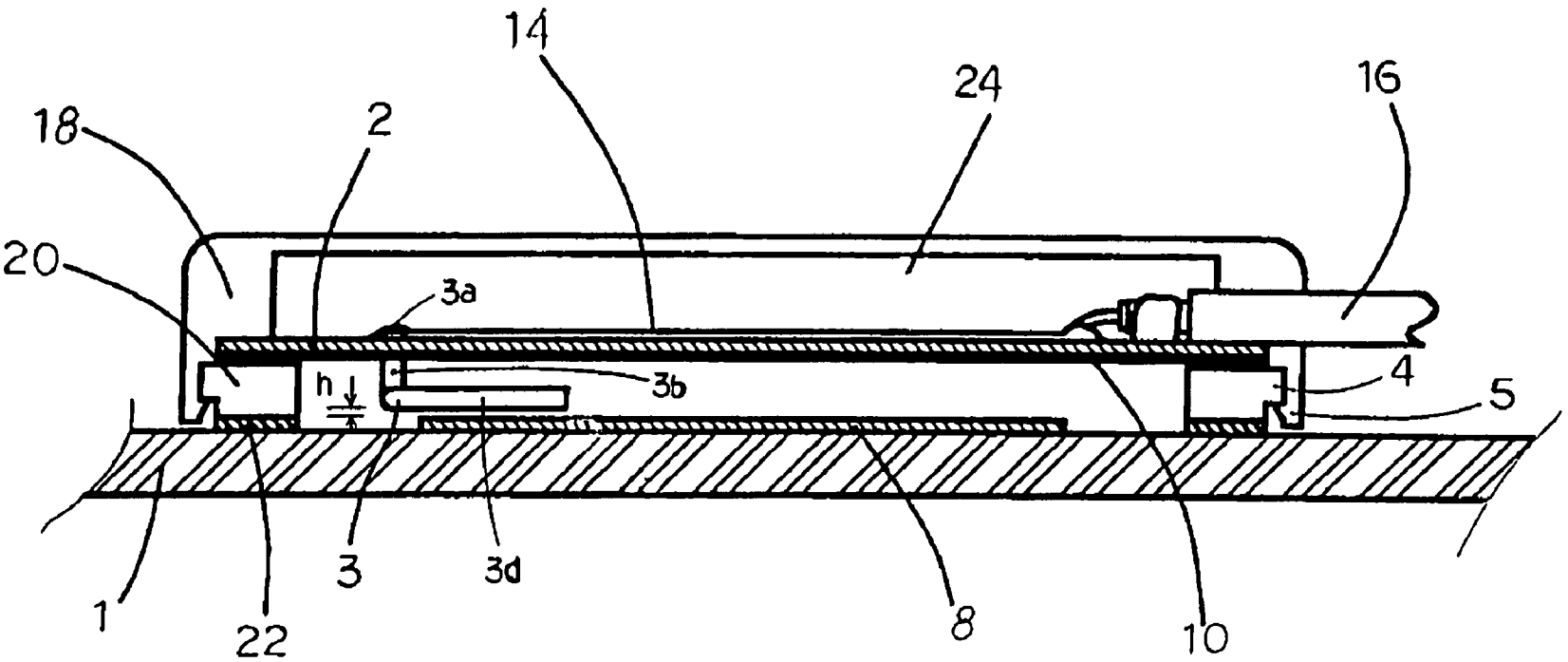
FIG. 1 is a cross-sectional view of the antenna device according to an embodiment of the present invention.

1: First dielectric substrate
2: Second dielectric substrate
2*a*: Hole
3: Conductor for electromagnetic coupling
3*a*: One end of conductor for electromagnetic coupling 3
4: Projection
5: Claw
7: Pillar-like conductor
8: Patch conductor
9: Edge of opening of car body
10: Grounding conductor
14: Transmission conductor
16: Coaxial cable
18: Upper casing
18*a*: Peripheral edge of upper casing 18
19: Island-like conductor
20: Lower casing
20*a*: Hole
22: Bonding portion
24: Space
25: Dielectric layer
26*a*: Dielectric substance A
26*b*: Dielectric substance B
27: Insulating supporting means
50: Slot

BEST MODE FOR CARRYING OUT THE INVENTION

Figure 2:
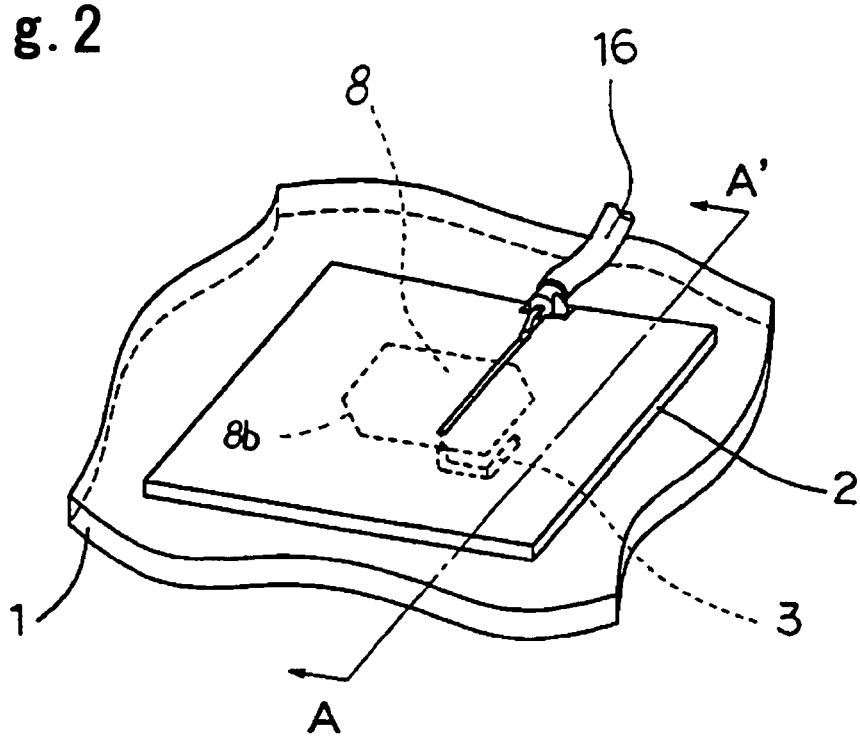
FIG. 2 is a schematic perspective view of essential components of the antenna device shown in FIG. 1.
Figure 3:
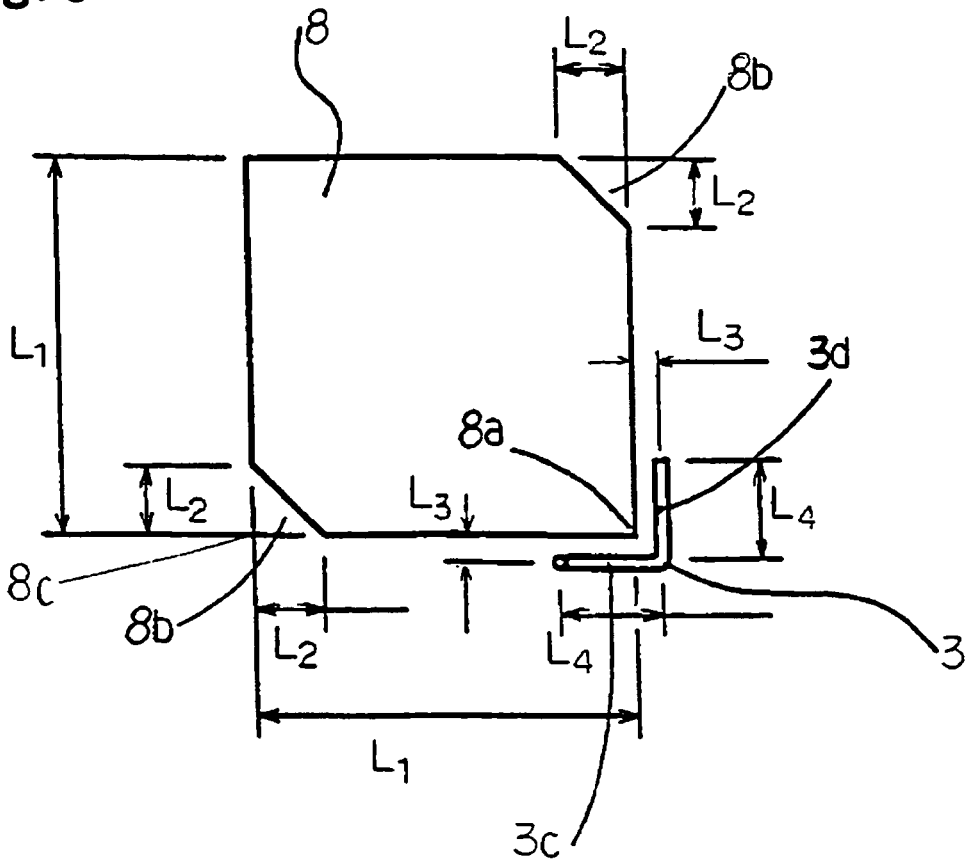
FIG. 3 is an enlarged plan view of a patch conductor 8 and a conductor for electromagnetic coupling 3 of the antenna device shown in FIG. 1.

Now, the antenna device according to the present invention will be described in detail based on preferred embodiments shown in the accompanying drawings. FIG. 1 is a cross-sectional view of the antenna device according to an embodiment of the antenna device of the present invention, and FIG. 2 is a schematic view of essential components of the antenna device. The cross-sectional view shown in FIG. 1 is cross-sectional view taken along line A-A' of FIG. 2, looking in the direction of the appended arrows. FIG. 3 is an enlarged plan view of a patch conductor 8 and a conductor for electromagnetic coupling 3 of the antenna device shown in FIG. 1, which shows the positional relationship between the patch conductor 8 and the conductor for electromagnetic coupling 3 in the embodiment shown in FIGS. 1 and 2, and which shows a first dielectric substrate 1 seen from an upper casing 18 in a direction perpendicular to a surface of the first dielectric substrate.

In accordance with the present invention, there are provided the first dielectric substrate 1 with the patch conductor 8 disposed thereon, and a second dielectric substrate 2 which is disposed so as to confront the first dielectric substrate 1 and which has a grounding conductor 10 disposed on a substrate surface confronting the patch conductor (hereinbelow, referred to as the second confronting substrate surface).

There is also provided the conductor for electromagnetic coupling 3, which extends from the second confronting substrate surface toward the first dielectric substrate 1 to be electromagnetically coupled with the patch conductor 8. The conductor for electromagnetic coupling 3 is not connected to the grounding conductor 10 with respect to a direct current.

The first dielectric substrate 1, and the second dielectric substrate 2 disposed so as to confront the first dielectric substrate 1 are apart from each other by a certain distance.

A lower casing 20 as a spacer is fixedly affixed to the first dielectric substrate 1 by a bonding portion 22. Thus, the antenna device is assembled so as to include an MSA antenna, wherein an upper casing 18 is fixed at a certain position on the first dielectric substrate 1, the conductor for electromagnetic coupling 3 is disposed at a certain position, and the second dielectric substrate 2 and the first dielectric substrate 1 are apart from each other at the certain distance by the spacer interposed between the second dielectric substrate 2 and the first dielectric substrate 1. The reason why the spacer is used as stated earlier is that when the first dielectric substrate 1 and the second dielectric substrate 2 are apart from each other by a distance of several mm or above in order to improve an antenna gain, it is possible to simplify the structure, to facilitate production and to increase productivity by using the spacer. An additional reason is that when a windowpane for a vehicle is used as the first dielectric substrate 1, the second dielectric substrate 2 can be reliably disposed on the windowpane since the spacer absorbs the curvature that the windowpane normally has. When the second dielectric substrate 2 is configured to be easily removable from the spacer, it is convenient for repair.

The patch conductor 8 is disposed on a confronting substrate surface of the first dielectric substrate 1, which confronts the second dielectric substrate 2, (hereinbelow, referred to as the first confronting substrate surface). In the embodiment shown in FIG. 1, the patch conductor 8 is formed in a hexagonal shape combining a square shape or a substantially square shape and cut-out portions formed in a corner and the opposite corner thereof, which is a shape effective for circularly polarized waves. However, the shape of the patch conductor is not limited to such a hexagonal shape and may be a rectangular shape, such as a square shape or an oblong shape, a substantially rectangular shape, a polygonal shape, a substantially polygonal shape, a circular shape, a substantially circular shape, a substantially oval shape, an oval shape or the like. In order to improve characteristics with respect to circularly polarized waves, it is preferred that the patch conductor 8 have the cut-out portions 8*b* formed therein. However, the patch conductor is not limited to have such a shape. The patch conductor 8 can be used without having the cut-out portions 8*b* formed therein. Although the shape of each of the cut-out portions 8*b* is a rectangular equilateral triangle or a substantially rectangular equilateral triangle in the embodiment shown in FIG. 1, the cut-out portions 8*b* are not limited to have such a shape.

The conductor for electromagnetic coupling 3 passes through a through hole (not shown) formed in the second dielectric substrate 2, and the conductor for electromagnetic coupling 3 has one end 3*a* connected, by soldering or the like, to a transmission conductor 14, which is disposed on the substrate surface of the second dielectric substrate 2 opposite the second confronting substrate surface (hereinbelow, referred to as the second non-confronting substrate surface) to function as a signal line. The conductor for electromagnetic coupling 3, which passes through the through hole, extends so as to project from the second confronting substrate surface. The projected portion is called a vertical portion 3*b* of the conductor for electromagnetic coupling 3.

A portion of the grounding conductor 10, which is disposed on the second confronting substrate surface in the vicinity of the through hole, is not connected to the vertical portion 3*b* with respect to a direct current. Additionally, it is preferred that a peripheral portion of the through hole and a portion of the grounding conductor 10 around the through hole be apart from each other by a gap of from 0.05 to 10 mm, particularly from 0.2 to 3 mm, in order to prevent the vertical portion 3*b* and the grounding conductor 10 from being electrically connected together. It is preferred in terms of a decrease in transmission loss that the gap be 0.05 mm or above. It is preferred in terms of the grounding conductor 10 ensuring to have a sufficient area that the gap be 10 mm or below.

In the embodiment shown in FIG. 1, the conductor for electromagnetic coupling 3 first extends from the second dielectric substrate 2 toward the first dielectric substrate 1 and extends parallel or substantially parallel to the patch conductor 8, being curved or bent before reaching the first confronting substrate surface. The extended portion of the conductor for electromagnetic coupling, which is located forward of the curved or bent portion, is called a first parallel portion 3*c*.

Additionally, the first parallel portion 3*c* is bent in the vicinity of a corner 8*a* of the patch conductor 8 and extends along a peripheral edge of the patch conductor 8, forming a second parallel portion 3*d*. The first parallel portion 3*c* and the second parallel portion 3*d* are both parallel or substantially parallel to the patch conductor 8 and are apart from the patch conductor 8 by a certain gap h in a direction perpendicular to a surface of the patch conductor 8.

In the embodiment shown in FIG. 1, the conductor for electromagnetic coupling 3 includes the first parallel portion 3*c* and the second parallel portion 3*d*, and the first parallel portion 3*c* and the second parallel portion 3*d* extend parallel or substantially parallel to peripheral edges of the patch conductor 8. Although it is preferred in terms of good electromagnetic coupling that the conductor for electromagnetic coupling be configured in this way, the conductor for electromagnetic coupling is not limited to have such a configuration. The conductor for electromagnetic coupling 3 is useful even without having the second parallel portion 3*d*. Portions of the conductor for electromagnetic coupling 3 close to the patch conductor 8 do not necessarily need to be parallel or substantially parallel with the patch conductor 8. Although the conductor for electromagnetic coupling 3 comprises a pillar-like conductor formed in a certain shape in this embodiment, the conductor for electromagnetic coupling is not limited to comprise such a pillar-like conductor. The conductor for electromagnetic coupling may comprise a conductive plate-like member formed in a certain shape.

Figure 6:
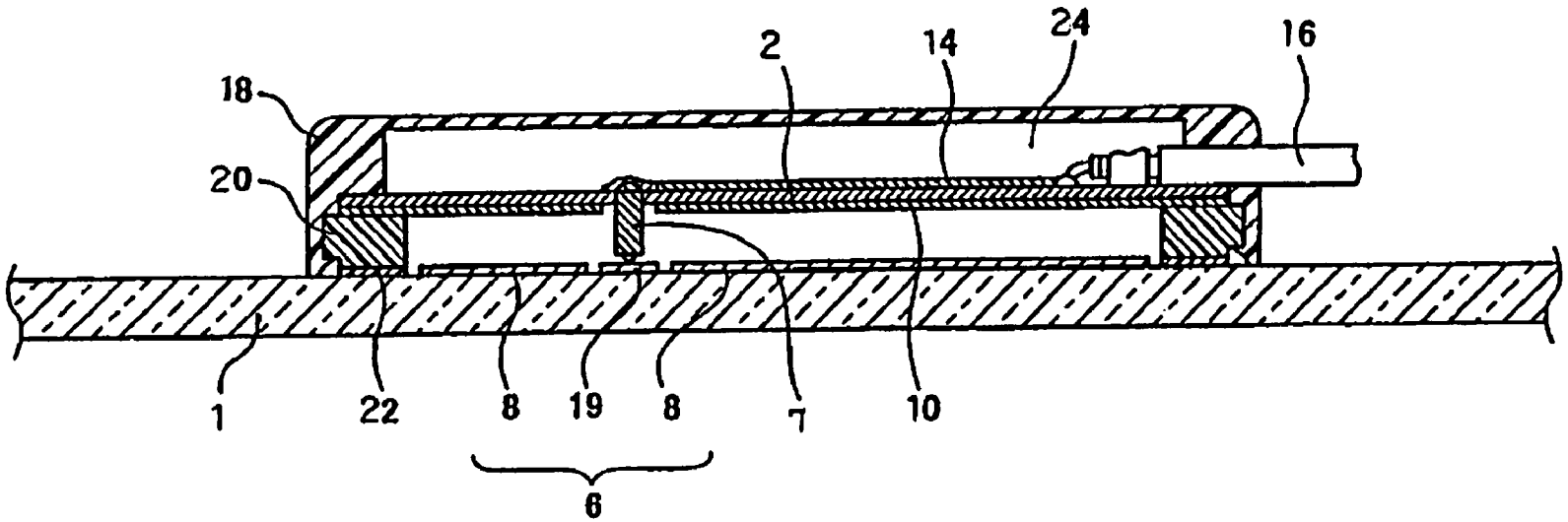
FIG. 6 is a cross-sectional view of the antenna device according to another embodiment of the present invention, which is different from the embodiment shown in FIG. 1.
Figure 7:
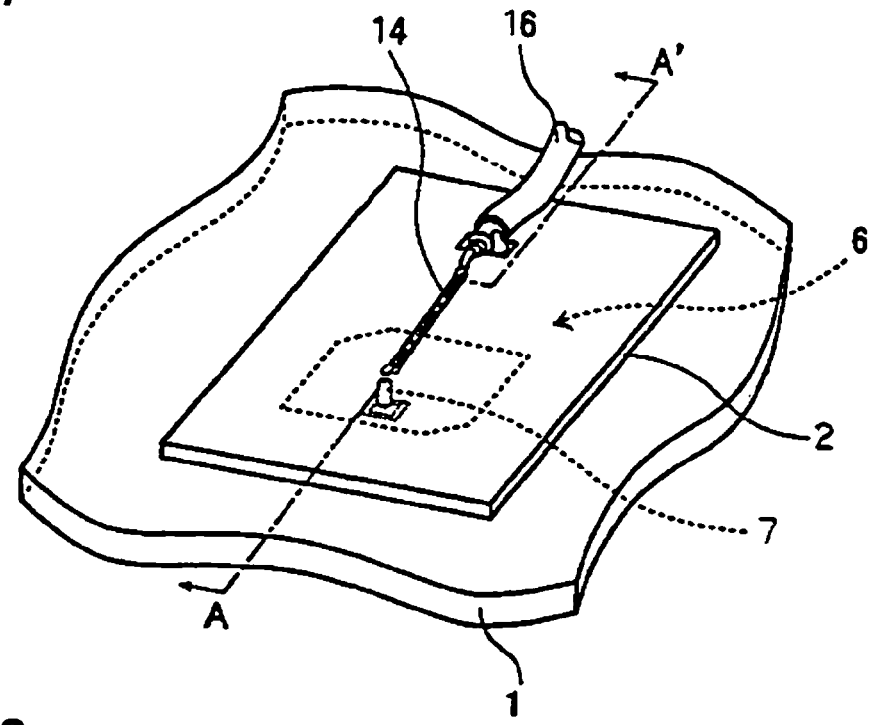
FIG. 7 is a schematic perspective view of essential components of the embodiment shown in FIG. 6.
Figure 8:
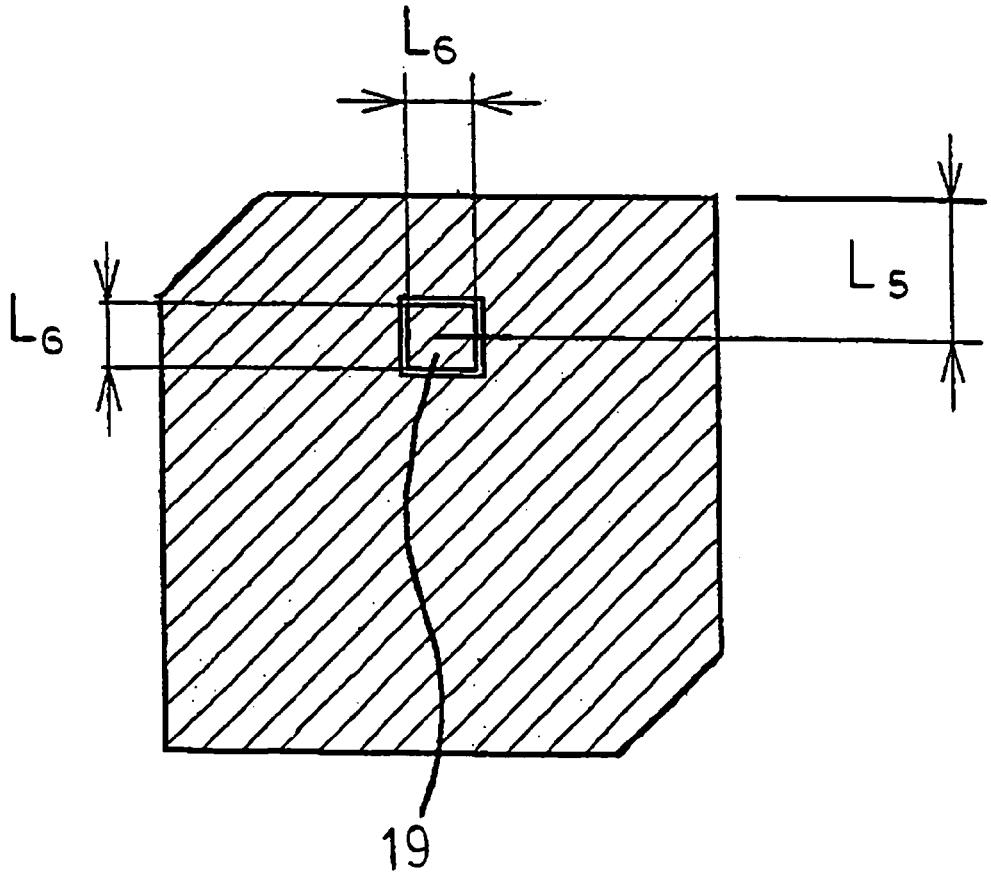
FIG. 8 is a plan view of the antenna element of the antenna device shown in FIG. 6.
Figure 9:
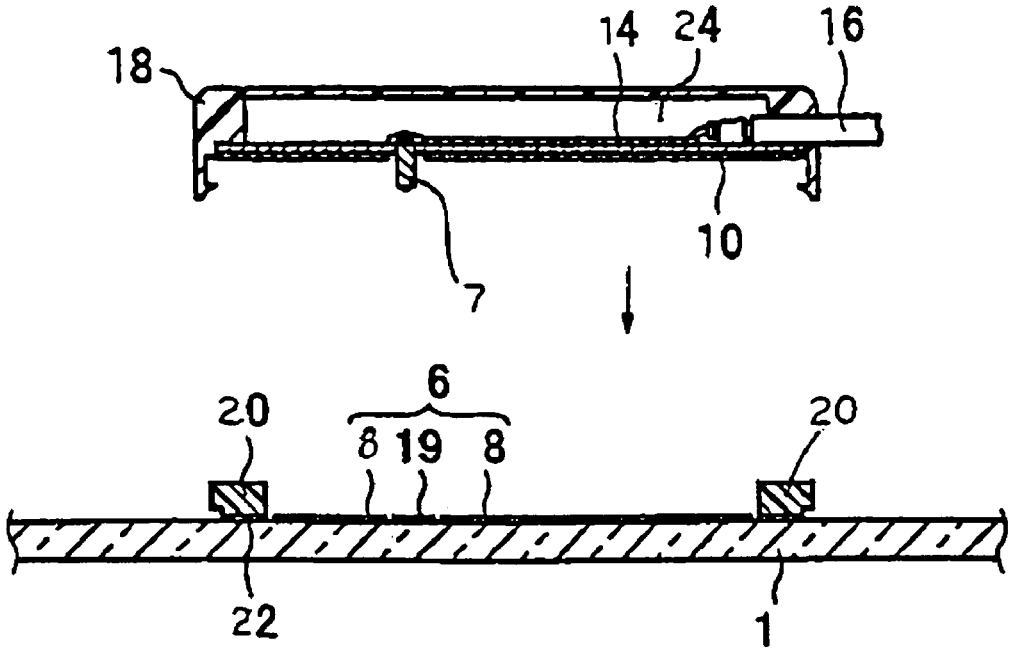
FIG. 9 is cross-sectional views explaining how to assemble the antenna device shown in FIG. 6.

FIG. 6 is a cross-sectional view showing the antenna device according to an embodiment of the present invention, which is different from the embodiment shown in FIG. 1. FIG. 7 is a schematic view of essential components of the embodiment shown in FIG. 6. The cross-sectional view shown in FIG. 6 is a cross-sectional view taken along line A-A' of FIG. 7, looking in the direction of the appended arrows. It should be noted that an upper casing 18 is not shown in FIG. 7. FIG. 8 is a plan view of the antenna element 6 of the embodiment shown in FIG. 6, and FIG. 9 is a schematic view explaining how to assemble the embodiment shown in FIG. 6.

The embodiment shown in FIG. 6 is configured so that a first dielectric substrate 1 and a second dielectric substrate 2 disposed so as to confront the first dielectric substrate 1 are apart from each other by a certain distance. The first dielectric substrate 1 has the antenna element 6 formed in a planar shape to radiate a radio wave.

The antenna element 6 includes a patch conductor 8 as a radiating conductor, and an island-like conductor 19 disposed so as to be separated from the patch conductor 8 and surrounded by the patch conductor 8 (see FIG. 8).

As shown in FIG. 8, the island-like conductor 19 is surrounded by the patch conductor 8 and comprises a rectangular conductor, which is separated from the patch conductor 8 by a gap having a width of, e.g., 0.5 mm and having no conductor. The island-like conductor 19 serves as a connection part of the antenna element 6 when a pillar-like conductor 7 is connected to the antenna element 6 as stated later. The island-like conductor 19 in the antenna element 6 is not limited to have a rectangular shape, and the island-like conductor may have a circular shape. There is no limitation to the shape of the island-like conductor.

In the embodiment shown in FIG. 6, the second confronting substrate surface has a grounding conductor 10 disposed therein, and the pillar-like conductor 7 is disposed so as to project from the second confronting substrate surface. The pillar-like conductor 7 has one end passing through a through hole formed in the second dielectric substrate 2 and connected to a transmission conductor 14 by soldering or the like to be fixed to the second dielectric substrate 2, the transmission conductor being disposed on the second non-confronting substrate surface and serving as a signal line. On the other hand, the pillar-like conductor 7 has the other end brought into contact with a substantially central portion of the island-like conductor 19 disposed on the first dielectric substrate 1. It is preferred that the grounding conductor 10 be disposed on the entire confronting substrate surface of the second dielectric substrate 2 except for the through hole formed in the second dielectric substrate 2 and a neighboring region around the through hole. The pillar-like conductor 7 projects from the second confronting substrate surface, being isolated from the grounding conductor 10 with respect to a direct current.

Thus, the pillar-like conductor 7 forms a signal line, which connects between the antenna element 6 and the transmission conductor 14, and which feeds a transmission signal from an external circuit to the patch conductor 8 on transmission and transmits a transmission signal from the patch conductor 8 to the external circuit through the transmission conductor 14, a coaxial cable 16 or the like on reception. The island-like conductor 19 is configured to be separated from the patch conductor 8 by the certain gap provided by lack of a conductor on the first dielectric substrate 1 and to be surrounded by the patch conductor 8. The island-like conductor 19 is connected to the pillar-like conductor 7. By this arrangement, the island-like conductor 19 functions as a capacitive correction element, which corrects the inductance of the pillar-like conductor 7 or the patch conductor 8. The island-like conductor 19 is adjusted to match with a characteristic impedance normally used in a high frequency signal line, such as 50 Ω. Specifically, the shape and the dimensions of the island-like conductor 19, the width of the gap between the island-like conductor 19 and the patch conductor 8 are adjusted in consideration of the inductance of the pillar-like conductor 7 and the inductance of the patch conductor 8. The pillar-like conductor 7 is connected to the antenna element 6 in terms of high frequency circuit in this way.

When a windowpane for a vehicle is used as the first dielectric substrate 1, there is a problem that the pillar-like conductor 7 cannot be connected to the island-like conductor 19. This is because a windowpane for a vehicle normally has a curvature and because the pillar-like conductor is difficult to be fitted to the island-like conductor in some cases since individual windowpanes have different curvatures. In such cases, it is preferred that a spring probe be used as the pillar-like conductor 7. When a spring probe is used as the pillar-like conductor 7, the pillar-like conductor 7 can be reliably brought into contact with and connected to the island-like conductor 19 without modification in the design of the entire antenna device shown in FIG. 6.

When a sprig probe is used as the pillar-like conductor 7, it is possible to smoothly manufacture products in mass production since variations in the warps of windowpanes, variations in the warps of second dielectric substrates 2 and the like can be absorbed. In this case, it is preferred that the spring probe have a stroke of from 0.2 to 1.5 mm, in particular from 0.2 to 0.8 mm.

The spring probe preferably has a pressing force of from 0.2 to 50 N from the viewpoint of preventing the island-like conductor 19 from being broken, preventing a contacted portion from being vibrated by vibration of a vehicle, such as an automobile, and preventing a repulsive force of the spring from making assembly difficult. In order to reduce electrical loss on signal transmission, it is preferred that the spring probe have a low electric resistance.

When the antenna device shown in FIG. 6 is assembled, the second dielectric substrate 2 is disposed so as to be apart from the first dielectric substrate 1 by a certain distance in such a state that the pillar-like conductor 7 is brought into contact with the island-like conductor 19 stated later. At this time, the contact position of the pillar-like conductor 7 varies according to assembly tolerances. The pillar-like conductor 7 can function as a capacitive correction element to absorb variations in the performance of the antenna element 6 caused by such assembly tolerances.

The pillar-like conductor 7 is configured so that, e.g., the other end of the pillar-like conductor to be brought into contact with the island-like conductor 19 comprises a spring probe supported by a spring, and that the other end of the pillar-like conductor 7 is urged toward the island-like conductor 19 by the elastic force of the spring when being brought into contact with the island-like conductor 19. Thus, the pillar-like conductor 7 can be smoothly brought into contact with the island-like conductor 19 without damaging the island-like conductor when assembling the antenna device shown in FIG. 6.

On the other hand, a lower casing 20 as a spacer is affixed and fixed to the first dielectric substrate 1 by the bonding portion 22. Thus, the antenna device is assembled to have a MSA antenna wherein the upper casing 18 is fixed to a certain position of the first dielectric substrate 1, the pillar-like conductor 7 is brought into contact with the center of the island-like conductor 19, and the second dielectric substrate 2 is held in parallel with the first dielectric substrate 1 so as to be apart from the first dielectric substrate by a certain distance.

Although a spring probe is referred to as an example of the pillar-like conductor 7, the upper casing 18 may have a substrate supporting system formed with an urging means, such as a spring or an elastic member, in order that the upper casing 18 urges the second dielectric substrate 2 toward the lower casing 20 to support and fix the second dielectric substrate, in place of such a spring probe. Any substrate supporting system is acceptable as long as at least the pillar-like conductor 7 is urged toward the island-like conductor 19 by an elastic force when the island-like conductor 19 is brought into contact with the pillar-like conductor 7.

The other end of the pillar-like conductor 7 may be preliminarily fixed and connected to the island-like conductor 19 of the antenna element 6 by soldering or the like without the pillar-like conductor 7 being preliminarily fixed to the second dielectric substrate 2. In this case, when the upper casing 18 is engaged with the lower casing 20, e.g., a socket formed in the second dielectric substrate 2 receives the one end of the pillar-like conductor 7 to connect the pillar-like conductor to the transmission conductor 14. In the embodiment shown in FIG. 6, any structure is acceptable as long as the pillar-like conductor 7 projects from the second dielectric substrate 2 so as to extend across the gap between the first dielectric substrate 1 and the second dielectric substrate 2. However, from the viewpoint that mounting can be practically done easily and shortly and that costs can be reduced, it is preferred to adopt the structure of the above-mentioned embodiment wherein the pillar-like conductor 7 is preliminarily disposed on the second dielectric substrate 2.

Although the pillar-like conductor 7, which extends across the gap between the first dielectric substrate 1 and the second dielectric substrate 2, is disposed at a single location in the embodiment shown in FIG. 6, the pillar-like conductor may be disposed at plural locations to be connected to the antenna element at plural different locations in the present invention. For example, when a signal is fed from two pillar-like conductors to the antenna element, a signal may be fed from the pillar-like conductors to the antenna element, being shifted in phase, as in case wherein a radio wave comprising a circularly polarized wave is radiated.

Although it is preferred from viewpoint of making the antenna device smaller that the dimensions of the grounding conductor 10 be reduced, it is preferred from the viewpoint of the antenna device having good directivity and having an impedance characteristic matched to increase a signal for transmission and reception that the dimensions of the grounding conductor 10 be increased. From the viewpoint, the length of a side of the grounding conductor 10 be a length of at least a half of the wavelength of a radio wave when the grounding conductor 10 is formed in a rectangular shape or a substantially rectangular shape. When the present invention is applied to an antenna device for a vehicle, it is preferred from the viewpoint of making the antenna device smaller that the grounding conductor 10 have an area of 3,960 $mm^2$ or below. The area of the grounding conductor 10 is more preferably 2,304 $mm^2$ or below, particularly preferably 1,920 $mm^2$, and much more preferably 1,760 $mm^2$. As stated earlier, the grounding conductor 10 may be formed in a rectangular shape or a substantially rectangular shape. It is preferred from the viewpoint of improving communication characteristics that the grounding conductor be formed in a square shape or a substantially square shape. However, the grounding conductor is not limited to have any one of these shapes, and the grounding conductor may be formed in a circular shape, a substantially circular shape, an oval shape, a substantially oval shape, a polygonal shape, a substantially polygonal shape or the like.

In each of the embodiments shown in FIGS. 1 and 6, the grounding conductor 10 is disposed on the second confronting substrate surface, and the transmission conductor 14, which comprises a conductor having a certain width, is disposed on the second non-confronting substrate surface, forming a microstrip line.

Figure 22:
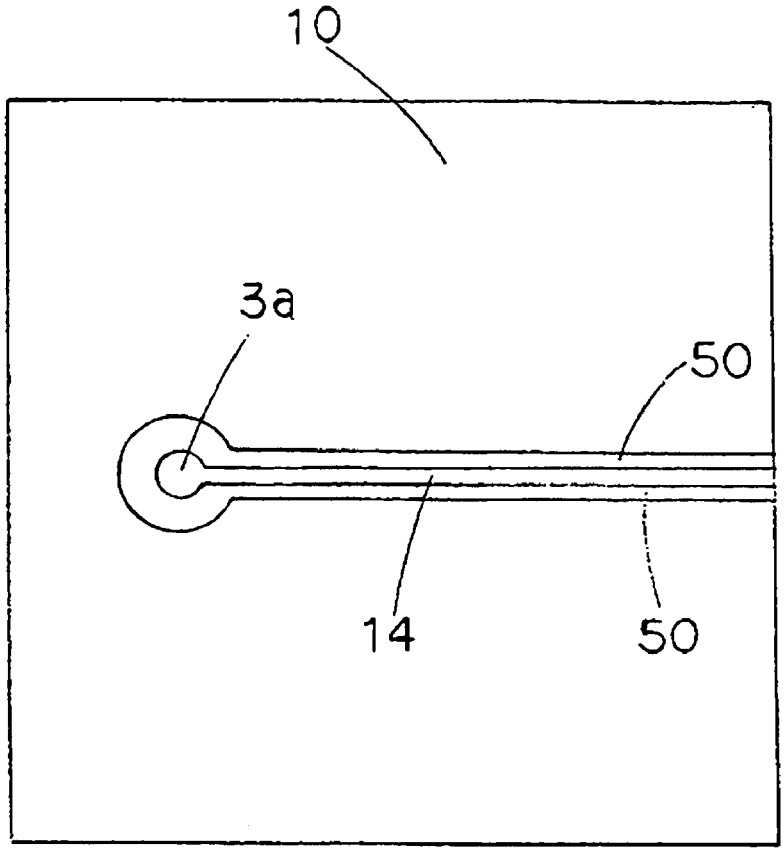
FIG. 22 is a plan view showing a grounding conductor 10 and a slot 50 in the present invention.

As shown in FIG. 22, the second non-confronting substrate surface may have the grounding conductor 10 disposed thereon, the second non-confronting substrate surface may additionally have a slot 50 disposed thereon without inclusion of the grounding conductor 10, the slot 50 may have the transmission conductor 14 disposed at a central portion or a substantially central portion thereof so as not to be connected to the grounding conductor 10 with respect to a direct current, and the conductor for electromagnetic coupling 3 or the pillar-like conductor 7 may pass through the second dielectric substrate 2 in a width direction thereof to be connected to the transmission conductor 14. In this embodiment, the slot 50 comprises an elongated region where no conductor is disposed on the dielectric substrate. In the slot 50, the material of the dielectric substrate is normally bared and exposed. However, the slot is not limited to have such a structure. The slot 50 may have an insulating substance disposed thereon.

In each of the embodiments shown in FIGS. 1 and 6, the transmission conductor 14 is disposed on the second non-confronting substrate surface, which is preferred from the viewpoint of improving antenna characteristics. However, the transmission conductor is not limited to be disposed on the second non-confronting substrate surface, and the transmission conductor 14 is useful even when is being disposed on the second confronting substrate surface. When the second confronting substrate surface has the transmission conductor 14 and the grounding conductor 10 disposed thereon, the grounding conductor 10 has the slot 50 formed therein, and the slot 50 has the transmission conductor 14 disposed therein at the central portion or the substantially central portion thereof so as not to be connected to the grounding conductor 10 stated earlier.

The second non-confronting substrate surface may have the grounding conductor disposed thereon, and the second confronting substrate surface may have the transmission conductor disposed thereon, although being not shown. In the present invention, at least one of the second confronting substrate surface and the second non-confronting substrate surface may have a dielectric layer disposed so as to be laminated thereon.

The transmission conductor 14 is connected to the center conductor of the coaxial cable 16 connected to an external circuit, such as an RF (Radio Frequency) circuit, outside the antenna device, and the grounding conductor 10 is connected to the outer conductor of the coaxial cable 16. It is preferred that the outer conductor of the coaxial cable 16 be grounded.

The patch conductor 8 disposed on the first dielectric substrate 1 and the grounding conductor 10 disposed on the second dielectric substrate 2 form an MSA wherein the space, such as air, existing in the gap between the first dielectric substrate 1 and the second dielectric substrate 2 serves as a dielectric member.

In the embodiment shown in FIG. 1, the conductor for electromagnetic coupling 3 is electromagnetically coupled to the patch conductor 8 to transmit a signal from the external circuit to the patch conductor 8 through the coaxial cable 16, the transmission conductor 14 or the like and to transmit a signal from the patch conductor 8 to the external circuit through the transmission conductor 14, the coaxial cable 16 or the like as stated earlier. The second dielectric substrate 2 is housed, supported and fixed at a certain position in the upper casing 18, and the upper casing 18 is configured to surround the patch conductor 8 and is engaged with the lower casing 20 fixed to the first dielectric substrate 1.

In the present invention, the distance between the patch conductor 8 and the grounding conductor 10 may be appropriately set according to the wavelength of a radio wave used in the antenna device from the viewpoint of ensuring transmission and reception performance of the antenna device.

Although the space of air, which exists the gap between the first dielectric substrate 1 and the second dielectric substrate 2, may serve as a dielectric member in the antenna device according to the present invention as stated earlier, it is preferred from the viewpoint of, e.g., making the antenna device smaller that a dielectric material as a dielectric substance, such as an adhesive or a filler be additionally filled and disposed in the gap.

When the dielectric substance interposed between the first dielectric substrate 1 and the second dielectric substrate 2 is called dielectric substance A, it is preferred in terms of production, repair or the like that dielectric substance A have fluidity, semi-fluidity or a non-curable property. When dielectric substance A has fluidity or semi-fluidity at least at the initial stage, and when the dielectric substance has a curable property or a semi-curable property with the lapse of time or by certain treatment, it is possible to reduce the occurrence of failure. The certain treatment contains any treatment wherein dielectric substance A is provided with a curable property or a semi-curable property by adding another substance to dielectric substance A to undergo chemical reaction or by heating the dielectric substance, for example.

When the first dielectric substrate 1 comprises a windowpane for a vehicle, which normally has a curvature, a dielectric substance having fluidity or semi-fluidity can be uniformly filled and disposed in the gap, which is preferable in terms of adhesion. When the antenna device according to the present invention includes an electronic component, such as an amplifier, it is possible to have an advantage of protecting such an electronic component from moisture, such as a droplet or humidity, which is preferable from a practical viewpoint. It is preferred that the dielectric substance have low loss in terms of avoiding a decrease in antenna characteristics, be flame-retardant, heat-resistant and cold-resistant when being used in a vehicle, and do not electrically corrode or erode another electronic component or a conductor, which is formed by baking conductive paste, such as silver paste.

When the antenna device according to the present invention cannot attain a desired antenna characteristic because of dielectric substance A having a small dielectric constant $\in_A$, it is preferred that dielectric substance M, which contains powder having a larger dielectric constant $\in_M$ than the dielectric constant $\in_A$, be mixed with dielectric substance A to apparently increase the dielectric constant of dielectric substance A.

Examples of dielectric substance A include silicone (high molecular weight organosilicon compound) having fluidity and excellent productivity, rubber or various kinds of synthetic resins. Dielectric substance A is not limited to be any one of these materials. Any dielectric substance that has a desired dielectric constant is acceptable.

The dielectric constant of silicone is normally from 2.3 to 4.3. When silicone or a dielectric substance having a similar dielectric constant is used as dielectric substance A, and when dielectric substance M is mixed with silicone as needed, it is preferred from the viewpoint of apparently increasing the dielectric constant of dielectric substance A effectively that the dielectric constant $\in_M$ be 8.0 above. It is more preferred in consideration of productivity that the dielectric constant $\in_M$ be from 8.0 to 12.0.

The powder contained in dielectric substance M and having the dielectric constant $\in_M$ preferably has a particle size (diameter) of from 0.1 to 50 μm, particularly preferably from 0.3 to 20 μm. It is preferred from the viewpoint of excellent productivity that the particle diameter be 0.1 μm or above. It is preferred in terms of stable antenna characteristics that the particle diameter be 50 μm or below.

Figure 5:
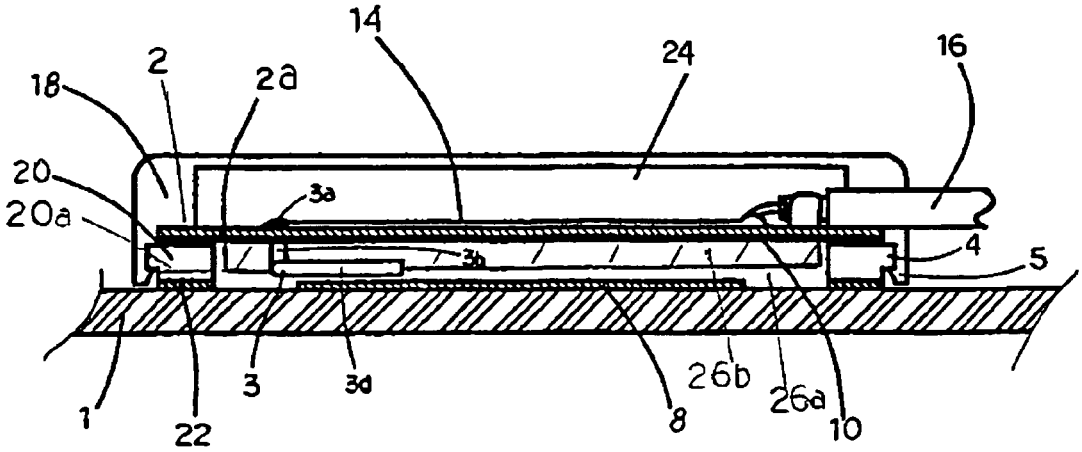
FIG. 5 is a cross-sectional view showing a modified embodiment of the embodiment shown in FIG. 1.

FIG. 5 is a cross-sectional view showing a modification of the embodiment shown in FIG. 1. In the modification shown in FIG. 5, cured dielectric substance B (which is a hatched portion 26*b* shown in FIG. 5) is disposed on the side of the second dielectric substrate 2 in the gap having a certain distance between the first dielectric substrate 1 and the second dielectric substrate 2. Additionally, dielectric substance A (which is a portion 26*a* shown in FIG. 5) having semi-fluidity or a non-curable property is disposed on the side of the first dielectric substrate 1. Conductor for electromagnetic coupling 3 is partly embedded in dielectric substance B, or the conductor for electromagnetic coupling 3 is partly brought into contact with dielectric substance B so that the conductor for electromagnetic coupling 3 is fixed by dielectric substance B in order to prevent a leading edge of the conductor for electromagnetic coupling 3 from being swayed by vibration. Thus, the antenna characteristics of the antenna device according to the present invention can be made stable.

In the antenna device according to the present invention, in a case wherein a radio wave to be used for communication has a wavelength of $\lambda_0$ in air, wherein a dielectric substance is interposed between the first dielectric substrate 1 and the second dielectric substrate 2 (between the patch conductor and the grounding conductor in each of the embodiments shown in FIGS. 1 and 6), wherein the dielectric substance has a dielectric constant of $\in_r$, and wherein the grounding conductor has an area of S, when the grounding conductor has a normalized width $W_g$ represented by $(S)^{0.5}\times(\in_r)^{0.5}/\lambda_0$, it is preferred that the formula of $0.42\leqq W_g\leqq 0.81$, particularity of $0.5\leqq W_g\leqq 0.6$ be established. It is preferred from the viewpoint of improving an antenna gain that the width $W_g$ be 0.42 or above. It is preferred from the viewpoint of making the antenna device smaller that the width $W_g$ be 0.81 or below.

For the same reason, in a case wherein dielectric substance A and dielectric substance B are interposed between the first dielectric substrate 1 and the second dielectric substrate 2 in the antenna device according to the present invention, when $(\in_A\cdot\in_B\cdot$(thickness of dielectric substance A+thickness of dielectric substance B))/($\in_B\cdot$thickness of dielectric substance A+$\in_A\cdot$thickness of dielectric substance B) is represented by $\in_q$ (an average value of the dielectric constant of the dielectric substances interposed between the patch conductor and the grounding conductor), when the grounding conductor has a normalized width $W_g$ represented by $(S)^{0.5}\times(\in_q)^{0.5}/\lambda_0$, with $\in_q$ being used instead of $\in_r$ defined as stated earlier, it is preferred that the formula of $0.42\leqq W_g\leqq 0.81$, particularity of $0.5\leqq W_g\leqq 0.6$ be established.

In the present invention, when a radio wave used in communication has a frequency of from 2.10 to 2.65 GHz, it is preferred that a dielectric substance be interposed between the first dielectric substrate 1 and the second dielectric substrate 2 or between the patch conductor and the grounding conductor, that the dielectric substance have a dielectric constant of from 1.89 to 5.20, that the grounding conductor 10 have an area of from 1,280 to 3,960 $mm^2$, and that the patch conductor have a vertical width $L_1$ or a horizontal width $L_1$ of from 21.3 to 36.11 mm. When the dielectric constant is 1.89 or above, when the grounding conductor 10 have an area of 1,280 $mm^2$ or above, and when $L_1$ is 21.3 mm or above, it is possible to improve the antenna gain. When the dielectric constant is 5.20 or below, it is possible to improve the antenna gain, to have excellent productivity and to produce the dielectric substance at a low cost. Additionally, when the grounding conductor 10 has an area of 3,960 $mm^2$ or below, it is possible to make the antenna device smaller. It is more preferred that the dielectric substance have a dielectric constant of from 2.30 to 3.10, and that the grounding conductor 10 have an area of from 1,280 to 1,920 $mm^2$. It is particularly preferred that the grounding conductor 10 have an area of from 1,440 to 1,760 $mm^2$.

In an embodiment of a minimum size of antenna device, which will be stated later, and wherein the grounding conductor 10 has an area of from 1,024 to 2,304 $mm^2$ in order to make the antenna device further smaller, the dielectric constant of the dielectric substance preferably ranges from 2.56 to 5.80. From this viewpoint, the dielectric constant of the dielectric substance preferably ranges from 1.89 to 5.80 in the present invention. The area of the grounding conductor 10 preferably ranges from 1,024 to 3,960 $mm^2$ in consideration of the embodiment of the minimum size of antenna device stated later, in the present invention.

In the present invention, in a case wherein the conductor for electromagnetic coupling is used as a signal feeding means, when a radio wave used in communication has a frequency of from 2.10 to 2.65 GHz, $L_1$ is from 21.5 to 34.85 mm, and the grounding conductor 10 has an area of from 1,024 to 2,304 $mm^2$. It is preferred that the conductor for electromagnetic coupling 3 have a length parallel or substantially parallel with the patch conductor 8 (a total length of the length of the first parallel portion 3*c* and the length of the second parallel portion 3*d*) of from 7.9 to 29.4 mm. When $L_1$ is from 21.5 to 34.85 mm, when the grounding conductor 10 has an area of 1,024 $mm^2$ or above, and when the conductor for electromagnetic coupling 3 has a length parallel or substantially parallel with the patch conductor 8 of from 7.9 to 29.4 mm, it is possible to improve the antenna gain. It is preferred from the viewpoint of making the antenna device smaller that the grounding conductor 10 have an area of 2,304 $mm^2$ or below. When a radio wave used in communication has a frequency of from 2.10 to 2.65 GHz, it is preferred from the viewpoint of improving the antenna gain that the gap between the patch conductor and the grounding conductor, that is to say, a substantial gap between the first dielectric substrate and the second dielectric substrate be from 3.6 to 10.8 mm.

Now, a case wherein a radio wave used in communication has a frequency of from 2.10 to 2.65 GHz, wherein the antenna device is made further smaller, and wherein the antenna gain is further improved in the present invention (the embodiment of a minimum size of antenna conductor) will be explained based on FIGS. 18 and 19 stated later. It is preferred that the grounding conductor 10 have an area from 1,024 to 2,304 $mm^2$.

In the minimum size embodiment, it is preferred that a dielectric substance be interposed between the patch conductor and the grounding conductor, that the dielectric substance have a dielectric constant of from 2.56 to 5.80, and the patch conductor have a vertical width $L_1$ or a horizontal width $L_1$ of from 19.0 to 29.0 mm. When these components are in their respective ranges, the antenna gain is improved in comparison with a case wherein these components are outside their respective ranges. The dielectric constants of the dielectric substance in Table 1 stated later are applied to a more preferred range and a particularly preferred range of the range with respect to the dielectric constant "from 2.56 to 5.80" stated just above, and this is also applicable to the following explanation.

The dielectric substance interposed between the patch conductor and the grounding conductor is not limited to be a single sort. At least one selected among air, dielectric substance A, dielectric substance B, dielectric substance M, an insulating sheet stated later, an insulating substrate stated later and other dielectric substances may be interposed between the patch conductor and the grounding conductor. In this case, it is preferred that the dielectric constant of at least one of plural sorts of dielectric substances except air be from 2.56 to 5.80. It is preferred that the dielectric constant of each of the dielectric substances except air be from 2.56 to 5.80.

In this case, when at least one selected among air, a single sort of dielectric substance except for air and a combination of plural sorts of dielectric substances is interposed between the patch conductor and the grounding conductor to form a dielectric inclusion, it is particularly preferred that the dielectric inclusion have a dielectric constant of from 2.56 to 5.80. The dielectric constant of the dielectric inclusion means the average value of the dielectric constant of the respective dielectric substances forming the dielectric inclusion, which is from 2.56 to 5.80. Although the dielectric constant of the dielectric inclusion preferably has a value obtained by measurement in a normal case, the dielectric constant may be a value obtained by calculation. When each of the dielectric substances has plural layers, the thickness and the dielectric constant of each of the dielectric substances are normally considered when finding the average value by calculation. When air is interposed between the patch conductor and the grounding conductor, the dielectric constant is calculated, including the dielectric constant of air.

As to how the respective dielectric substances are interposed, each of the dielectric substances may have plural layers, and each of the dielectric substances may comprise a block of dielectric substance or have air bubbles mixed therein. When the grounding conductor is disposed on or in the second non-confronting substrate surface, the second dielectric substrate is also contained in the category of these dielectric substances. For example, a dielectric plate or a dielectric layer (such as a ceramic plate or a ceramic layer) and an air layer are interposed between the patch conductor and the grounding conductor, the thickness and the dielectric constant of the dielectric plate or the dielectric layer are set so that the average value of the dielectric constant of the dielectric plate or the dielectric layer and the dielectric constant of the air layer (1.0) is from 2.56 to 5.80.

For example, when the dielectric plate or the dielectric layer comprises a dielectric substance having a dielectric constant of from 8.0 to 20.0, particularly from 12.0 to 16.0, and when the average value of the dielectric constants of air and the dielectric substance is set to be from 2.56 to 5.80, it is possible to produce is the antenna device at a low cost and to improve productivity.

Additionally, it is preferred from the viewpoint of improving the antenna gain that the gap between the patch conductor and the grounding conductor be from 2.92 to 15.3 mm. When the gap is in this range, the antenna gain is improved in comparison with a case wherein the gap is outside this range. When the patch conductor 8 has the cut-out portions 8*b* formed therein, it is preferred that imaginary sides having a right angle 8*c* included therebetween in each of the cut-out portions 8*b* have a length $L_2$ of from 0.77 to 16.7 mm. When the length is in this range, the antenna gain is improved in comparison with a case wherein the length is outside this range.

In the minimum size embodiment, when a conductor for electromagnetic coupling is used as the signal feeding means, and when the conductor for electromagnetic coupling has a portion parallel or substantially parallel with the patch conductor, it is preferred that the length of the conductor for electromagnetic coupling parallel with or substantially parallel with the patch conductor be from 3.95 to 28.7 mm. When the length is in this range, the antenna gain is improved in comparison with a case wherein the length is outside this range. Now, a preferred range, a more preferred range, and a particularly preferred range in the minimum size embodiment are collectively listed in Table 1.

TABLE 1

| | Preferred range | More preferred range | Particularly preferred range |
|---|---|---|---|
| Area of grounding conductor ($mm^2$) | 1,024 to 2,304 | 1,280 to 1,920 | 1,440 to 1,760 |
| $L_1$ (mm) | 19.0 to 29.0 | 20.5 to 27.5 | 22.0 to 26.5 |
| Dielectric constant of dielectric substance stated above (mm) | 2.56 to 5.80 | 2.90 to 5.20 | 3.30 to 4.50 |
| Gap between patch conductor and grounding conductor (mm) | 2.92 to 15.3 | 3.60 to 12.4 | 5.1 to 9.5 |
| $L_2$ (mm) | 0.77 to 16.7 | 3.10 to 13.5 | 5.40 to 10.4 |
| Length of portion of conductor for electromagnetic coupling 3 in parallel or substantially parallel with patch conductor 8 (mm) | 3.95 to 28.7 | 8.70 to 23.7 | 11.7 to 19.8 |

In the present invention, when the conductor for electromagnetic coupling is used as a signal feeding means, when the conductor for electromagnetic coupling has a portion parallel or substantially parallel with the patch conductor, when a radio wave used in communication has a frequency of from 2.10 to 2.65 GHz, and when the dielectric substance interposed between the first dielectric substrate 1 and the second dielectric substrate 2 comprises air, it is preferred from the viewpoint of improving the antenna gain that the fist parallel portion 3*c* and the second parallel portion 3*d* have a total length of from 4.7 to 49.3 mm, particularly from 18.8 to 34.0 mm.

Also in the present invention, when the conductor for electromagnetic coupling is used as a signal feeding means, and when the conductor for electromagnetic coupling has a portion parallel or substantially parallel with the patch conductor, it is preferred from the viewpoint of improving the antenna gain that the dielectric substance interposed between the first dielectric substrate 1 and the second dielectric substrate 2 comprise air, that $L_1$ be from 32.68 to 41.80 mm, and that the first parallel portion 3*c* and the second parallel portion 3*d* have a total length of from 10.4 to 27.3 mm. In this case, it is preferred that the grounding conductor 10 have an area of from 3,240 to 3,960 $mm^2$. It is preferred from the viewpoint of improving the antenna gain that the grounding conductor 10 have an area of 3,240 $mm^2$ or above. It is preferred from the viewpoint of making the antenna device smaller that the grounding conductor 10 have an area of 3,960 $mm^2$ or below.

In the present invention, when the conductor for electromagnetic coupling is used as a signal feeding means, and when the conductor for electromagnetic coupling has a portion parallel or substantially parallel with the patch conductor, it is preferred that the portion of the conductor for electromagnetic coupling parallel or substantially parallel with the patch conductor 8 (the fist parallel portion 3*c* and the second parallel portion 3*d*) have an axis overlapping with the patch conductor 8 in a three-dimensional view, and that the axial center of the portion and a peripheral edge of the patch conductor have a gap $L_3$ of from −1.17 to −2.42 mm therebetween in a three-dimensional view. When $L_3$ is a negative value, the first parallel portion 3*c* and the second parallel portion 3*d* of the conductor for electromagnetic coupling 3 overlap with the patch conductor 8 in a three-dimensional view, and the first parallel portion 3*c* and the second parallel portion 3*d* are disposed inside the patch conductor 8 in a three-dimensional view. It is preferred that $L_3$ is smaller than −1.17. This is because the conductor 3 for electromagnetic coupling does not serve as a radiating conductor and does not have an adverse effect on directivity even if the antenna device shown in FIG. 1 is slanted with respect to the coming direction of a radio wave. It is preferred from the viewpoint of having a good signal feeding state that $L_3$ be larger than −2.4.

In the present invention, when the conductor for electromagnetic coupling is used as a signal feeding means, when the conductor for electromagnetic coupling has a portion parallel or substantially parallel with the patch conductor, when a radio wave used in communication has a frequency of from 2.10 to 2.65 GHz, and when the dielectric substance interposed between the first dielectric substrate 1 and the second dielectric substrate 2 has a dielectric constant of from 1.89 to 5.20, it is preferred from the viewpoint of improving the antenna gain that the first parallel portion 3*c* and the second parallel portion 3*d* of the conductor for electromagnetic coupling 3 have a total length of from 8.7 to 28.7 mm.

The conductor for electromagnetic coupling 3 may comprise copper, tin, aluminum, iron, silver, gold, platinum or an alloy thereof, or a member made of any one of these materials and having a plated surface.

When the antenna device according to the present invention is used for a vehicle, and when the conductor for electromagnetic coupling 3 is not fixed by cured dielectric substance B unlike in the embodiment shown in FIG. 5, it is preferred from the viewpoint of having a mechanical strength to withstand vibration that the conductor for electromagnetic coupling 3 be made of a material having a Young's modulus of $5\times10^{10}$ Pa or above, particularly $7\times10^{10}$ Pa or above. It is preferred from the viewpoint of having a mechanical strength to withstand vibration and effectively feeding a signal that the conductor for electromagnetic coupling 3 have a cross-sectional area of from 0.16 to 16 $mm^2$, particularly from 0.64 to 2.25 $mm^2$. Although the conductor for electromagnetic coupling 3 may be formed in a circular shape, a polygonal shape or the like in cross-section, it is preferred in consideration of productivity that the conductor be formed in a circular shape.

It should be noted that it is preferred in terms of assemblage of the antenna device that a mounting operation for engaging the upper casing 18 with the lower casing 20 be simple. Additionally, it is preferred that the boundary surface, through which a radio wave passes, is reduced to prevent the patch conductor 8 from being adversely affected in terms of transmission or reception performance. From this viewpoint, it is preferred to use a dielectric material having low loss as the dielectric member or to use a space of air as the dielectric member.

In the present invention, the second dielectric substrate 2 may comprise a single-layered substrate or a multi-layered substrate. In each of the embodiments shown in FIGS. 1 and 6, the second dielectric substrate 2 comprises a single-layered substrate. It is preferred from the viewpoint of improving productivity that the second dielectric substrate comprise a single-layered substrate. However, the present invention is not limited to this mode, and the second dielectric substrate 2 may comprise a multi-layered substrate.

When the second dielectric substrate 2 comprises a single-layered substrate, the second dielectric substrate 2 has the grounding conductor 10 and the transmission conductor 14 disposed thereon in each of the embodiments shown in FIGS. 1 and 6. The present invention is not limited to this mode. The antenna device according to the present invention can be used even if at least one of the grounding conductor 10 and the transmission conductor 14 is disposed in the second dielectric substrate 2.

When the second dielectric substrate 2 comprises a multi-layered substrate, it is preferred that the grounding conductor 10 and the transmission conductor 14 be disposed in different layers. However, the present invention is not limited to this mode. The antenna device according to the present invention can be used even if the grounding conductor 10 and the transmission conductor 14 be disposed in the same layer. When the grounding conductor 10 and the transmission conductor 14 are disposed in the same layer, the layer may have a slot disposed therein without inclusion of the grounding conductor 10, the slot may have the grounding conductor 14 disposed in a central or substantially central portion thereof so as not to be connected to the grounding conductor 10 with respect to a direct current, and the conductor for electromagnetic coupling 3 or the pillar-like conductor 7 may be passed through the second dielectric substrate 2 in the width direction to be connected to the transmission conductor 14.

Although various kinds of signal feeding means have been described with respect to the present invention, the signal feeding means used in the present invention is not limited to the signal feeding means stated above or the signal feeding means stated later. Other signal feeding means are applicable as long as required antenna performance can be brought out.

Examples of the material of the first dielectric substrate 1 and the material of the second dielectric substrate 2 include various kinds of dielectric materials, such as resin, ceramic or glass. As the second dielectric substrate 2, various kinds of printed boards, such as a printed board comprising a glass fabric base material and a fluorine resin and having both surfaces coated with copper, a glass epoxy board or a ceramic board, are applicable. It is preferred that the second dielectric substrate be durable and can be produced at a low cost.

Each of the patch conductor 8, the grounding conductor 10 and the transmission conductor 14 may comprise, e.g., a conductor, which is prepared by printing conductive paste, such as silver paste, on a dielectric substrate and baking the printed conductive paste, a conductor, which is prepared by applying conductive paint to a dielectric substrate, or a conductor, which is prepared by affixing copper foil to a dielectric substrate, or another conductor. As another mode, each of these components may comprise copper foil, which is disposed on a flexible printed board having a negligible thickness with respect to the wavelength of a radio wave. In this case, the patch conductor 8 or the like may be formed by affixing the above-mentioned flexible printed board to a different dielectric substrate through a bonding layer, an adhesive layer or the like, which is extremely thin. As stated earlier, there is no limitation to the material and the fabricating step of the patch conductor 8 and the like.

There is no limitation to the materials of the upper casing 18 and the lower casing 20. These components may be formed by any kinds of resin, such as ABS (acrylonitrile butadiene styrene) resin, PEK (polyether ketone) resin, PBT (polybutylene terephthalate) resin, PPS (polyphenylene sulfide) resin, PP (polypropylene) resin or PA (polyamide) resin. A suitable resin is selected in terms of durability required for the antenna device, the adhesive property of a bonding agent to the first dielectric substrate or costs.

The bonding portion 22, by which the lower casing 20 is affixed to the first dielectric substrate 1, may comprise, e.g., an acrylic form tape (manufactured by 3M Corporation) having a thickness of 0.8 mm as a double-sided adhesive tape. There is no limitation to the thickness and the material of the tape. Various kinds of double-sided adhesive tapes or adhesives may be used in consideration of the adhesive property or the durability of the material of the first dielectric substrate 1 and the material of the lower casing 20.

When the first dielectric substrate 1 comprises a windowpane for a vehicle, such as an automobile, and when the grounding conductor 10 has an area of from 1,024 to 2,304 $mm^2$, it is preferred that, a spacer, which comprises, e.g., the lower casing 20, be bonded to the windowpane 1 so as to surround the patch conductor 8, and that the bonding portion, where the spacer is boned to the windowpane, have an area of from 150 to 770 $mm^2$. Considering that the spacer preferably has a vertical tensile strength of 196 N or above, the spacer has a mechanical strength to be capable of withstanding vibration when the bonding portion has an area of 150 $mm^2$ or above. When the bonding portion, where the spacer is bonded to the windowpane, has an area of 770 $mm^2$ or below, the antenna device can be made smaller. In this case, it is preferred from the viewpoint of having a required mechanical strength and of making the antenna device smaller that the bonding portion 22, where the spacer is bonded to the windowpane, have a bonding strength of 0.4 $N/mm^2$ or above.

Figure 4:
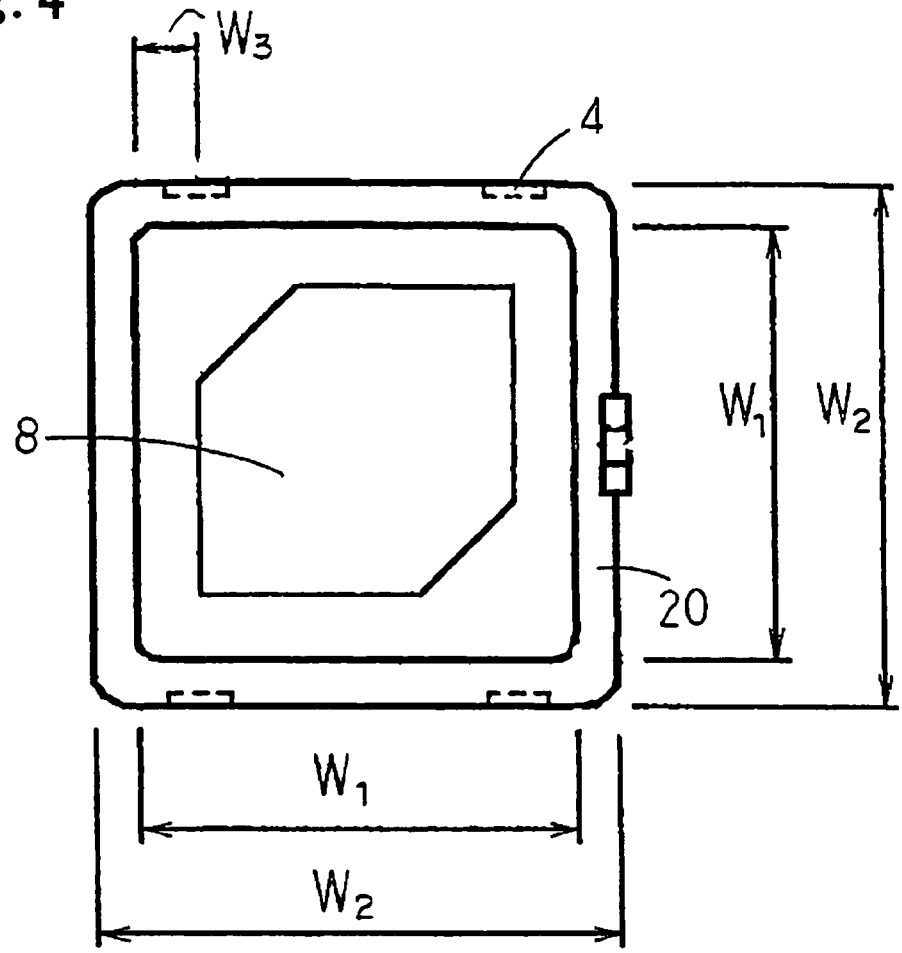
FIG. 4 is a plan view showing an embodiment wherein a lower casing 20 as a spacer is bonded to a windowpane.

FIG. 4 is a plan view showing an embodiment wherein the lower casing 20 as the spacer is bonded to the windowpane. In the embodiment shown in FIG. 4, the lower casing 20 is bonded to and disposed on the windowpane so as to depict the four sides of a square shape or the four sides of a substantially square shape in a strip shape. In FIG. 4, reference $W_1$ designates the width of an inner peripheral edge of the lower casing 20, reference $W_2$ designates the width of an outer peripheral edge of the lower casing 20, and reference $W_3$ designates the shortest distance between a side of the peripheral edge of the lower casing 20 and the patch conductor 8.

In the present invention, when the radio wave to be used in communication has a frequency of from 2.10 to 2.65 GHz, when a dielectric substance is interposed between the first dielectric substrate 1 and the second dielectric substrate 2 or between the patch conductor and the grounding conductor, and when the dielectric substance has a dielectric constant in the preferred range (from 2.56 to 5.80), the more preferred range or the particularly preferred range shown in Table 1, it is preferred that $W_2$ be from 33 to 50 mm. This is because the antenna gain is improved when $W_2$ is 33 mm or above and because the antenna device can be made smaller when $W_2$ is 50 mm or below. In this case, when the first dielectric substrate comprises a windowpane of a vehicle, in particular an automobile, it is preferred that the bonding portion 22 have a thickness of from 0.4 to 3.0 mm. When the bonding portion 22 has a thickness of 0.4 mm or above, it is possible to absorb the curvature of the windowpane. When the bonding portion 22 has a thickness of 3.0 mm or below, it is possible to have excellent productivity.

As shown in FIG. 5, the lower casing 20 as the spacer may have an aperture 20*a* formed therein, and/or the second dielectric substrate 2 may have an aperture 2*a* formed therein for introduction of dielectric substance A. By forming such an aperture, it is possible to use an instrument, such as an injector, to introduce dielectric substance A having fluidity through such an aperture in fabrication after the spacer and the second dielectric substrate 2 have been disposed on the windowpane.

In each of the amendments shown in FIGS. 1 and 6, the grounding conductor has a portion disposed between the lower casing 20 as the spacer and the second dielectric substrate. In such a case, it is preferred from the viewpoint of the antenna gain being affected by the dielectric constant of the lower casing 20 that the dielectric constant of the lower casing 20 be from 1.89 to 12.0, particularly from 2.7 to 4.0. When the dielectric constant of the lower casing 20 is 1.89 or above, it is possible to improve the antenna gain. When the dielectric constant of the lower casing 20 is 12.0 or below, it is possible to have excellent productivity.

In each of the amendments shown in FIGS. 3 and 8, the patch conductor 8 is configured to have a pair of opposite corners of a square shape cut out so as to form the cut-out portions 8*b*, whereby a radio wave radiated from the rectangular patch conductor 8 is caused to be a circularly polarized wave.

The patch conductor 8 shown in FIG. 3 is configured so as to be adapted for transmitting and receiving a left-hand circularly polarized wave. The patch conductor 8 shown in FIG. 8 is configured so as to be adapted for transmitting and receiving a right-hand circularly polarized wave. The patch conductor according to the present invention can be configured so as to cope with both of a right-hand circularly polarized wave and a left-hand circularly polarized wave by changing the positions of the paired cut-out portions 8*b*. When the patch conductor has no cut-out portion 8*b*, the patch conductor can be adapted for a linearly polarized wave. The patch conductor 8 may be provided with such a configuration by using a known technique similar to a technique for forming a required configuration in the patch conductor in MSA, such a technique described in "Small and Planar Antenna" (Haneishi et al, The Institute of Electronics, Information and Communication Engineers). In particular, when the patch conductor is adapted for a circularly polarized wave, the patch conductor may be partly formed with cut-out portions or projected portions, and a perturbation element may be used.

Although the patch conductor 8 shown in each of FIGS. 3 and 8 is configured so as to be adapted for transmitting and receiving a left-hand circularly polarized wave, the patch conductor according to the present invention is not limited to be configured so as to be adapted for a left-hand circularly polarized wave. The patch conductor according to the present invention may be configured so as to be adapted for a linearly polarized wave or a right-hand circularly polarized wave in addition to a left-hand circularly polarized wave. The patch conductor 8 may be configured by using a known technique similar to a technique for forming a required configuration in the patch conductor in MSA, such as a technique described in "Small and Planar Antenna" (Haneishi et al., The Institute of Electronics, Information and Communication Engineers). In particular, when the patch conductor is adapted for a circularly polarized wave, the patch conductor may be partly formed with cut-out portions or projected portions, and a perturbation element may be used.

In order to make the patch conductor 8 smaller, various known methods for making the patch conductor smaller, which have been used for MSA, may be used. The patch conductor may be slitted, the outline of the patch conductor 8 may be formed in a known Koch curve as a fractal structure, and the patch conductor 8 may be formed so as to have a pattern of a known Sierpinski's gasket as a fractal structure.

In the embodiment shown in FIG. 1, since the upper casing 18 is engaged with the lower casing 20 affixed to the first dielectric substrate 1, the upper casing is fixed at a certain position on the first dielectric substrate 1, whereby the conductor for electromagnetic coupling 3 is disposed to be close to the patch conductor 8 so as to be electromagnetically coupled with the patch conductor 8 while the second dielectric substrate 2 is apart from the first dielectric substrate 1 by a certain distance.

A fabrication sequence for the embodiments shown in FIGS. 1 and 6 will be described.

(1) When the first dielectric substrate 1 comprises a windowpane for a vehicle, the patch conductor 8 is first disposed on the windowpane. In other words, a windowpane with the patch conductor disposed thereon is prepared.

The step for disposing the patch conductor 8 on the windowpane is performed by printing paste containing conductive metal, such as silver paste, on an interior surface of the windowpane by, e.g., screen printing, and baking the paste. However, the present invention is not limited to this disposing method. Foil made of a conductive substance, such as copper, may be disposed on the interior surface of the windowpane or in the windowpane. A mark, which is used for positioning when the bonding portion 22 is formed on the windowpane in a subsequent step, may be simultaneously disposed by the step for disposing the patch conductor 8.

(2) Next, the bonding portion 22 is disposed on the windowpane or on the lower casing 20.

(3) The lower casing 20 is affixed at a certain position on the windowpane so that the spacer is bonded to the windowpane through the bonding portion.

(4) The upper casing 18 is preliminarily prepared, having the second dielectric substrate 2 housed in a certain position, supported and fixed therein, the second dielectric substrate having the conductor for electromagnetic coupling 3 or the pillar-like conductor 19 disposed thereon and having the coaxial cable 16 connected to the transmission conductor 14.

(5) A dielectric substance is disposed on the grounding conductor 10 disposed on the second dielectric substrate 2. The upper casing 18 is engaged with the lower casing 20 on the windowpane for a vehicle so that a projection 4 as a first fixing means, which is formed on an outer peripheral portion of the lower casing 20, is engaged or interlocked with a claw 5 as a second fixing means, which is formed on an inner peripheral portion of the upper casing 18. In other words, the upper casing 18 is mounted to the lower casing 20 so as to cover the second dielectric substrate 2 by fixing the second fixing means to the first fixing means. The windowpane thus treated is fitted into an opening of the vehicle. In the present invention, the phrase "fixing" covers engagement, fixture, bond and other fixing methods.

A windowpane with the lower casing 20 preliminarily mounted thereto may be fitted into an opening of a vehicle, and the upper casing 18 may be mounted to the lower casing after the windowpane has been mounted to the opening. The method for mounting the upper casing 18 to the first dielectric substrate 1 is not limited to the embodiments shown in FIGS. 1 and 6. The upper casing 18 may be mounted to the first dielectric substrate 1 through the bonding portion 22 without provision of the lower casing 20. In this case, the upper casing 18 serves as the spacer.

When a dielectric substance having fluidity is disposed on the grounding conductor 10 disposed on the second dielectric substrate 2, the second dielectric substrate 2 may be fixed to the spacer by disposing a molding frame on the second dielectric substrate 2, causing the dielectric substance to lose the fluidity or to slightly lose the fluidity after introduction of the dielectric substance into the molding frame, followed by removing the molding frame. It is preferred that the molding frame have such a shape and dimensions to prevent the dielectric substance on the second dielectric substrate 2 from colliding against the spacer when the second dielectric substrate 2 is fixed to the spacer. The molding frame may be configured in a shape substantially similar to, e.g., the lower casing 20 shown in FIG. 1, provided that the projection 4 is not formed.

In the embodiment shown in FIG. 6, since the upper casing 18 is engaged with the lower casing 20 affixed to the first dielectric substrate 1 to be fixed at a certain position on the first dielectric substrate 1, the pillar-like conductor 7 is brought into contact with the island-like conductor 19 to be connected to the antenna element 6 while the second dielectric substrate 2 is apart from the first dielectric substrate 1 by a certain distance.

When the first dielectric substrate 1 comprises a windowpane for a vehicle, the antenna element 6 is disposed on the windowpane for a vehicle, and the lower casing 20 is affixed so as to surround the antenna element 6 by the bonding portion 22 or the like. On the other hand, the second dielectric substrate 2, which has the pillar-like conductor 7 disposed thereon and the transmission line connected to the coaxial cable 16, is preliminarily housed, fixed and supported at a certain position in the upper casing 18, and the upper casing 18 is engaged with the lower casing 20 affixed to the windowpane. Thus, it is possible not only to assemble the antenna device according to the present invention and but also to mount the antenna device to the windowpane. Accordingly, it is possible to realize an antenna device, which has no need for connection components, such as a connector, which is inexpensive, compact and highly durable and which is easily fabricated and has excellent practicality.

Although the second non-confronting substrate surface has the transmission conductor 14 as a microstrip line disposed thereon and connected to the axial cable 16 by soldering in the embodiment shown in FIG. 1, the present invention is not limited to this mode. The coaxial cable 16, which is connected to an external circuit, such as an RF circuit, may be connected to the transmission conductor 14 by a connector.

In the space 24 between the second dielectric substrate 2 and the upper casing 18, a circuit component, such as an LNA (Low Noise Amplifier), may be mounted on the substrate surface of the second dielectric substrate 2 with the transmission conductor 14 disposed thereon. In particular, when the antenna device according to the present invention is used for receiving a feeble signal from a satellite, it is preferred that the space 24 be utilized to mount a circuit component, such as an LNA. When the second dielectric substrate 2 is held so as to be inclined to the first dielectric substrate 1, it is possible to adjust the distribution of the directivity of the antenna device. In the embodiment shown in FIG. 6, an island-like conductor as a capacitive correction element may be disposed so as to match with the input impedance of a circuit component, such as an LNA, and the dimensions and the gap of the island-like conductor may be adjusted.

In the present invention, when the first dielectric substrate 1 comprises a windowpane for a vehicle, it is preferred that the patch conductor 8 be disposed on an interior surface of the windowpane. It is preferred that the windowpane comprise a front windshield or a backlite. The windowpane may have a optically shielding layer disposed thereon, and the upper casing 18 or the like may be formed on the shielding layer. An example of the shielding layer is a ceramic layer, such as a black ceramic layer.

Figure 21:
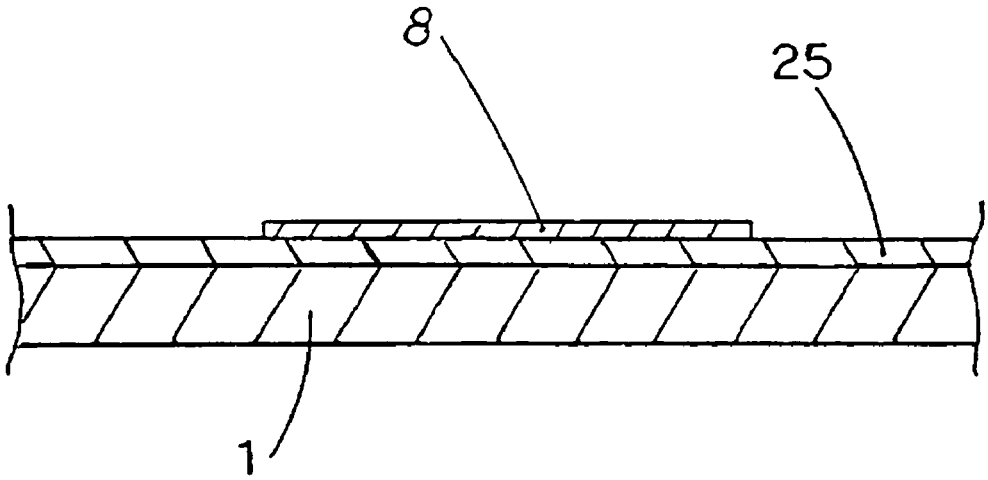
FIG. 21 is a cross-sectional view of a portion of a patch conductor 8, which has a dielectric film 25 interposed on an interior surface of a windowpane.

The patch conductor 8 and a windowpane for a vehicle may have a shielding layer disposed therebetween. Specifically, a portion or the entire portion of the patch conductor 8 may be disposed on a dielectric film 25, which comprises the shielding layer or the like disposed on the windowpane 1 as shown in FIG. 21. In this case, the patch conductor 8 is optically shielded by the shielding layer when the windowpane is seen from an exterior side of the vehicle. Thus, the windowpane has an excellent design since the antenna device cannot be seen from the exterior side.

When a front windshield comprises laminated glass, the antenna device according to the present invention may be disposed on an interior side of the laminated glass, and a colored intermediate film may be sandwiched between the mating surfaces of the laminated glass, whereby the antenna device is shielded so as to be invisible from an exterior side of the laminated glass. The color of the intermediate film is not limited to black.

Figure 23:
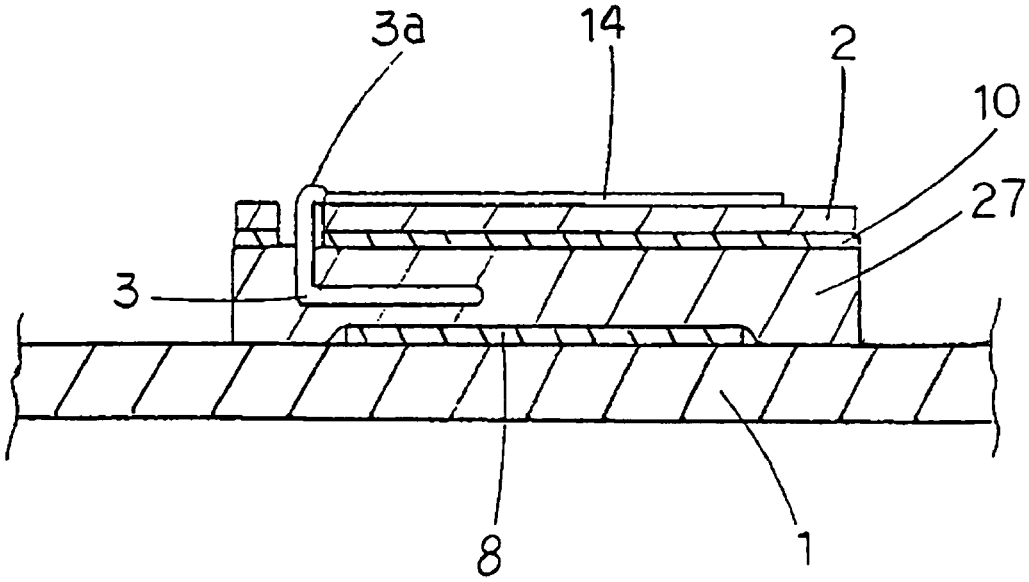
FIG. 23 is a cross-sectional view showing another embodiment, which is different from the amendments shown in FIGS. 1 and 6.

Explanation of an embodiment different from the embodiments shown in FIGS. 1 and 6 will be made, referring to FIG. 23. This embodiment is directed to a microstrip antenna, which comprises the patch conductor 8 disposed on an interior surface of a windowpane for a vehicle as the first dielectric substrate 1, an insulating sheet or an insulating substrate disposed on the windowpane so as to confront the patch conductor 8, (hereinbelow, collectively referred to the insulating sheet or the insulating substrate as the insulating supporting means 27 in some cases), and the grounding conductor 10 disposed on the insulating supporting means 27. Thus, the insulating supporting means 27 is disposed on the patch conductor 8 in this embodiment. By adopting such an arrangement, the antenna device can be completed even without the second dielectric substrate 2. The insulating supporting means 27 serves as a replacement of the spacer and the above-mentioned dielectric substance. Accordingly, the grounding conductor 10 can be supported so as to be apart from the patch conductor 8 by a certain distance by the insulating supporting means 27 even when the spacer is not disposed on the windowpane unlike in the embodiments shown in FIGS. 1 and 6. In the embodiment shown in FIG. 23, the coaxial cable and the like are not shown.

In this embodiment, the grounding conductor 10 is normally disposed on a surface of the insulating supporting means 27 opposite to the patch conductor 8. In this case, it is preferred that the grounding conductor 10 have a slot formed therein, and that a transmission conductor be disposed at a central portion or a substantially central portion of the slot so as to not to be connected to the grounding conductor 10 with respect to a direct current. The grounding conductor 10 may be disposed in the insulating supporting means 27. In this case, although it is preferred that the transmission conductor 14 be disposed on a surface of the insulating supporting means 27 remote from the patch conductor 8, the transmission conductor 14 may be disposed in the insulating supporting means 27 so as not to be connected to the grounding conductor 10 with respect to a direct current.

When the insulating supporting means 27 has a multi-layered structure, and when the grounding conductor 10 is disposed in a layer of the multi-layered structure, it is preferred that the grounding conductor 10 have a slot formed therein, and that the grounding conductor be disposed at a central portion or a substantially central portion of the slot so as not to be connected to the grounding conductor 10 with respect to a direct current.

When the antenna in this embodiment comprises the second dielectric substrate 2, the second dielectric substrate 2 is disposed on a surface of the insulating supporting means 27 remote from the windowpane. The second dielectric substrate 2 may have a single-layered structure or a multi-layered structure. In this case, the grounding conductor 10 may be disposed on a surface of the second dielectric substrate 2 close to the insulating supporting means 27, in the second dielectric substrate 2, or a surface of the second dielectric substrate 2 remote from the insulating supporting means 27 without the grounding conductor 10 being disposed on the insulating supporting means 27.

When the transmission conductor 14 is disposed on the second dielectric substrate 2, the grounding conductor 10 may be disposed on the surface of the second dielectric substrate 2 close to the insulating supporting means 27, in the second dielectric substrate 2 or the surface of the second dielectric substrate 2 remote from the insulating supporting means 27.

When the second dielectric substrate 2 is disposed on the insulating supporting means 27, and when the second dielectric substrate 2 comprises a multi-layered substrate, the grounding conductor 10 may be disposed on the surface of the second dielectric substrate 2 close to the insulating supporting means, in a layer of the second dielectric substrate 2 or the surface of the second dielectric substrate 2 remote from the insulating supporting means 27. In this case, when the transmission conductor 14 is disposed on the same surface or the same layer of the second dielectric substrate 2 as the grounding conductor 10, the grounding conductor 10 may have a slot formed therein, the transmission conductor 14 may be disposed at a central portion or a substantially central portion of the slot so as not to be connected to the grounding conductor 10 with respect to a direct current, and the conductor for electromagnetic coupling 3 or the pillar-like conductor 7 may pass through the second dielectric substrate 2 in the thickness direction of the second dielectric substrate and be connected to the transmission conductor 14.

The insulating sheet or the insulating substrate may comprise a single-layered sheet or a single-layered substrate. It is preferred from the viewpoint of the improving productivity that the insulating sheet or the insulating substrate have such a structure. However, the present invention is not limited to this mode. The insulating sheet or the insulating substrate may comprise a multi-layered sheet or a multi-layered substrate.

When a signal feeding conductor, such as the coupling conductor for electromagnetic coupling 3 or the pillar-like conductor, is used as a signal feeding means, the insulating supporting means 27 has a hole, a through hole, a groove or the like formed therein as required so that such a signal feeding conductor can be disposed between the patch conductor 8 and the grounding conductor 10. Irrespectively of whether the second dielectric substrate 2 as another mode of signal feeding means is disposed on the insulating supporting means 27 or not, a signal feeding means, such as a signal feeding conductor or a coaxial cable, may be disposed between the patch conductor 8 and the grounding conductor 10 to electrically connect between the patch conductor 8 and the signal feeding means. A dielectric layer may be disposed and laminated on at least one of the surface of the insulating supporting means 27 close to the windowpane and the surface of the insulating supporting means remote from the windowpane.

Each of the provision of the grounding conductor 10 on the insulating supporting means 27, the provision of the grounding conductor on the windowpane and the provision of the second dielectric substrate 2 on the insulating supporting means 27 is normally made by bonding by using an adhesive. However, the present invention is not limited to this mode. Other modes are acceptable. The insulating sheet may be made of a synthetic resin, rubber or the like. The insulating substrate may be made of ceramics, a synthetic resin, glass or the like. However, each of the insulating sheet and the insulating substrate is not limited to be made of such a material. Both members may be made of any material as long as the material has a proper dielectric constant and a required mechanical strength.

Figure 20:
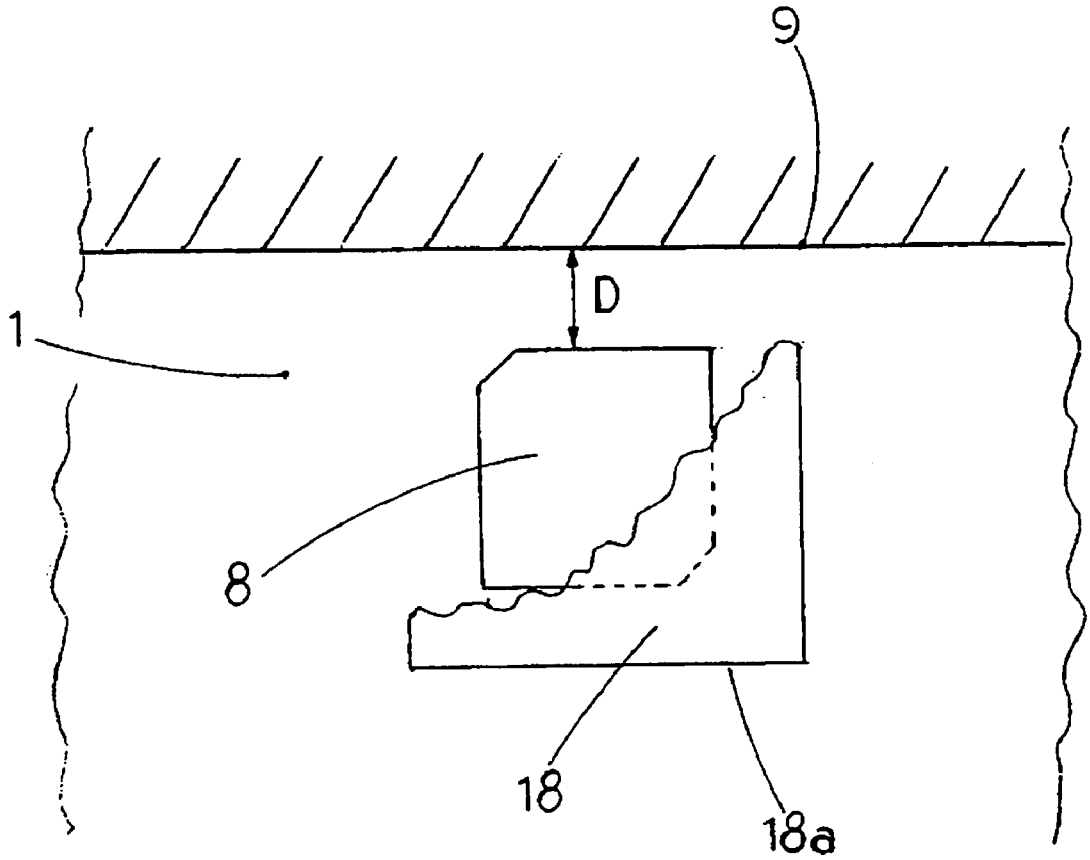
FIG. 20 is a plan view showing a mode, wherein an antenna device is disposed on a windowpane.

In a case wherein the first dielectric substrate 1 comprises a windowpane for a vehicle in the present invention as shown in FIG. 20, when a radio to be used in communication has a wavelength of $\lambda_0$ in air, and when the shortest distance between the patch conductor 8 and an edge of an opening in the car body 9 is D, it is preferred from the viewpoint of improving the antenna characteristic that the formula of $0.01 \leqq D/\lambda_0$ be established. The edge of the opening of the car body 9 means a peripheral edge of an opening of the car body, into which the windowpane is fitted, which serves as grounding the car body, and which is made of, e.g., a conductive material, such as metal. The antenna device can be used even when the grounding conductor 10 is close to or brought into contact with the edge of the opening of the car body 9 to be electrically connected to the edge. In order to prevent a driver's view from being disturbed, it is preferred the antenna device according to the present invention be disposed on the windowpane so that the shortest distance between the edge of the opening of the car body 9 and a portion of the antenna device farthest from the edge of the opening of the car body 9 (a peripheral edge 18*a* of the upper casing 18 in the embodiment shown in FIG. 20) be 200 mm or below, in particular 100 mm or below. In FIG. 20, the grounding conductor 10 or the like is not shown.

When the antenna device according to the present invention is disposed on a front windshield, it is preferred the antenna device be disposed in a range of 100 mm on both sides of the center line in the horizontal direction of the front windshield when being mounted to the vehicle. In particular, it is preferred from the viewpoint of preventing a driver's view from being disturbed and of good interior design that the antenna device according to the present invention be disposed so as to be positioned behind a rear view mirror when seen from a driver's view.

The antenna device according to the present invention is applicable not only to an antenna device for receiving a satellite broadcast using a frequency band of 2.3 GHz but also to various kinds of data communication, such as ETC or DSRC (Dedicated Short Range Communication) using a similar frequency to ETC. For example, the antenna device according to the present invention is also applicable to transmit and receive a radio wave in a band of 800 MHz, a band of 1.5 GHz, a band of 1.8 GHz and a band of 1.9 GHz for telephone, a band of 1.2 GHz and a band of 1.5 GHz for GPS (Global Positioning System), a band of 2.3 GHz and a band of 2.6 GHz for digital satellite broadcasting, and a band of 2.5 GHz of VICS (Vehicle Information and Communication System). The antenna device according to the present invention is also applicable to transmit and receive a radio wave in a UHF band (from 300 MHz to 3 GHz), a high frequency band (from 3 GHz to 30 GHz) and a millimeter wave band (from 30 GHz to 300 GHz) in addition to the above-mentioned bands.

EXAMPLES

Now, the present invention will be described, referring to examples. The present invention is not limited to these examples. It is to be understood that modification and variation of the present invention may be made without departing from the spirit and scope of the present invention.

Example 1

Figure 11:
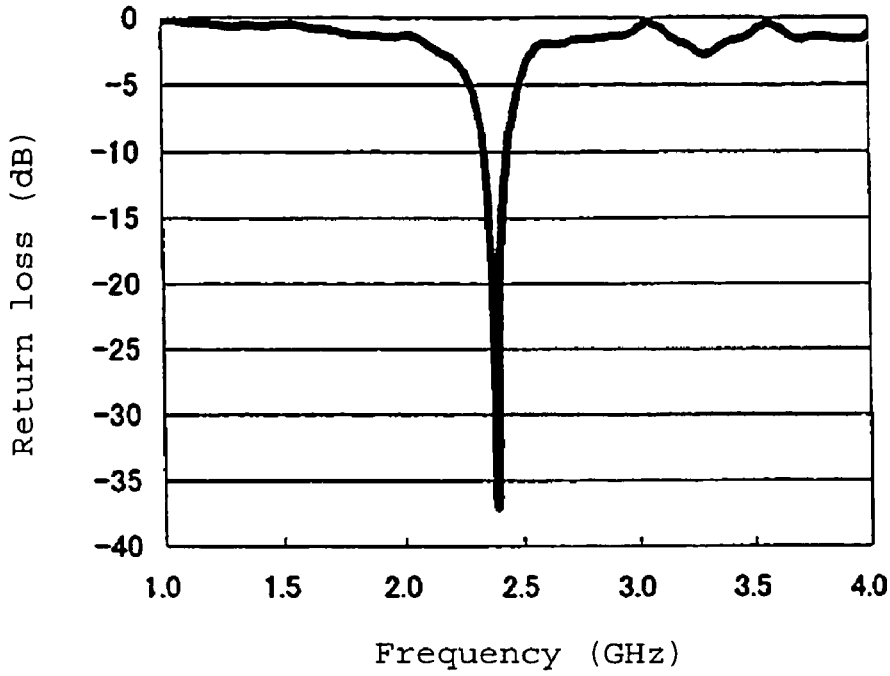
FIG. 11 is a graph showing a return loss-frequency characteristic of Example 1.
Figure 12:
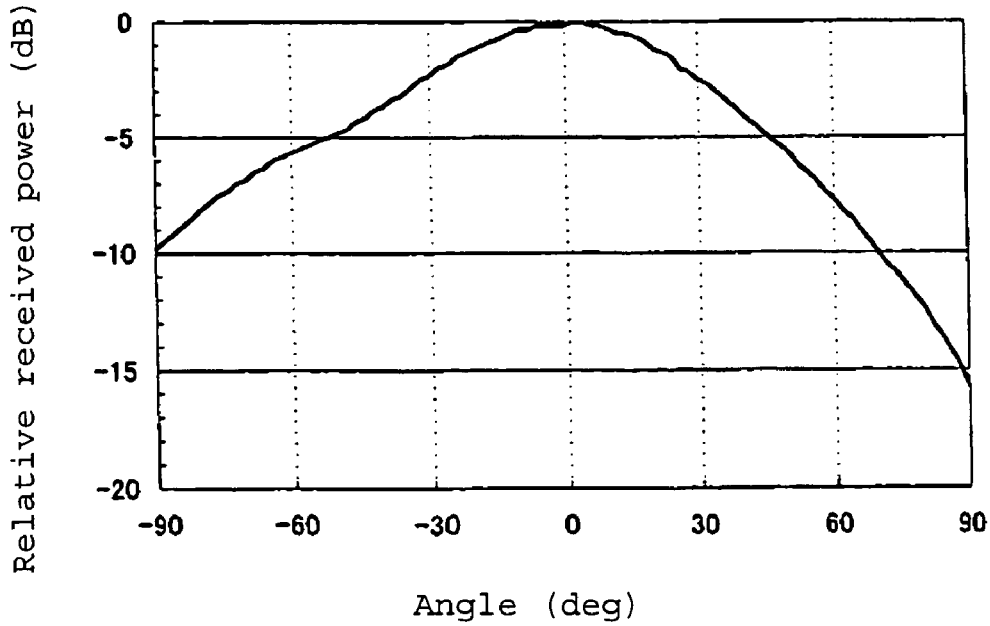
FIG. 12 is a graph showing a directivity of Example 1.

A windowpane for an automobile was used to fabricate an antenna device as shown in FIG. 1. A glass plate was used as the first dielectric substrate 1, and a printed board, which comprised a glass fabric base material and a fluorine resin and had both surfaces coated with copper, was used as the second dielectric substrate 2. The dielectric substance between the glass plate and the printed board comprised air. A copper wire with a coating of tin applied thereon was used as the conductor for electromagnetic coupling 3. The antenna device was set at an operational frequency of 2.3 GHz. The dimensions and constants of the respective components are as follows. A return loss-frequency characteristic of this embodiment is shown in FIG. 11, and a directivity of this embodiment is shown in FIG. 12.

| | |
|---|---|
| Thickness of glass sheet | 3.5 mm |
| Printed board (length × width × thickness) | 60.0 × 60.0 × 0.8 mm |
| Dielectric constant of printed board | 3.4 |
| $L_1$ | 37.0 mm |
| $L_2$ | 6.0 mm |
| $L_3$ | 2.5 mm |
| $L_4$ | 10.0 mm |
| Diameter of conductor for electromagnetic coupling 3 | 1.0 mm |
| h | 0.5 mm |
| Distance between printed board and glass plate | 4.5 mm |
| Length of one side (horizontal width, vertical width) of square grounding conductor 10 | 60.0 × 60.0 mm |

Silver paste was printed on the glass plate and baked to form the patch conductor 8. The upper casing 18 and the lower casing 20 were made of an ABS resin material. The lower casing 20 had a thickness of 3 mm. In order to bond the lower casing 20 to the glass plate, an acrylic form tape having a thickness of 0.8 mm was used as the bonding portion 22 to affix the lower casing 20 to the glass plate.

In order to pass the conductor for electromagnetic coupling 3 through the printed board, a through hole was formed in the printed board so as to have substantially the same diameter as the conductor for electromagnetic coupling 3. A portion of the copper foil on the second confronting substrate surface was removed in a neighboring region of 0.5 mm (a circle having a diameter of 2.0 mm) around the through hole and the copper foil on the substantially entire region of the second confronting substrate surface except for the neighboring region around the through hole was used as the grounding conductor 10. The transmission conductor 14, which comprised a microstrip line made of copper foil, was disposed on the second non-confronting substrate surface.

One end of the conductor for electromagnetic coupling 3 was inserted into the through hole formed in the printed board, the one end was connected to the transmission conductor 14 by soldering, and the conductor for electromagnetic coupling 3 was fixed to the printed board. Additionally, the coaxial cable 16 for connection with the transmission conductor 14 was mounted to the printed board.

The antenna device in this example resonated at substantially 2.3 GHz and received a radio wave of substantially 2.3 GHz as seen from FIG. 11. Although the patch conductor 8 was configured so as to serve as an antenna for a left-hand circularly polarized wave in this example, the radiated radio wave had good directivity with respect to a left-hand circularly polarized wave as shown in FIG. 12, which proved that the antenna device in this example served as an antenna for a left-hand circularly polarized wave having a good directivity.

Example 2

Figure 13:
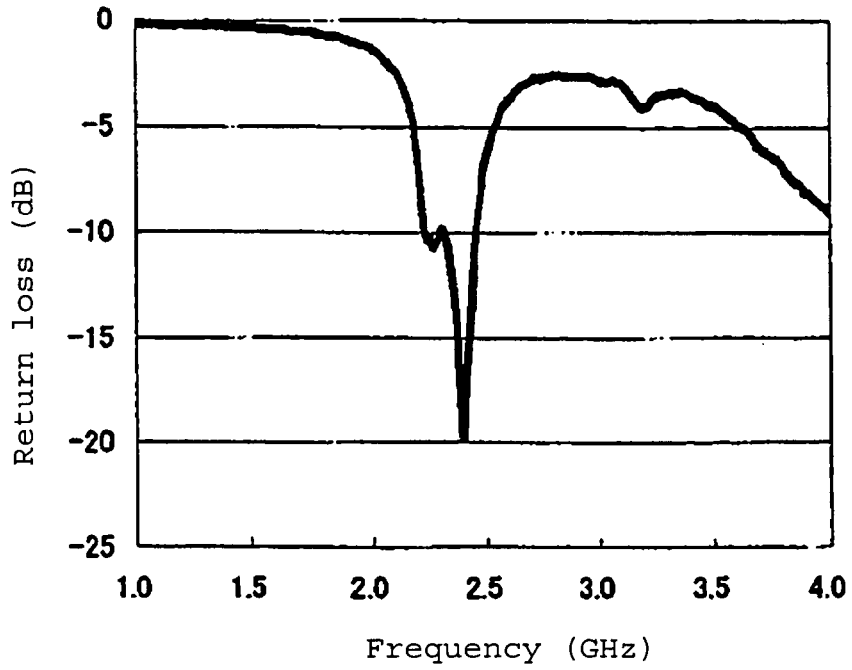
FIG. 13 is a graph showing a return loss-frequency characteristic of Example 2.

An antenna device was fabricated as shown in FIG. 6. A glass plate similar to the one used in Example 1 was used as the first dielectric substrate 1, and a printed board, which comprised a glass fabric base material and had both surfaces coated with copper, and which was similar to the one used in Example 1, was used as the second dielectric substrate 2. The antenna element 6 was designed so as to resonate at a frequency of 2.3 GHz, radiating a radio wave. The dimensions and the constants of the respective components are stated below. A return loss-frequency characteristic of this example is shown in FIG. 13, and a directivity of this example shown in FIG. 14.

| | |
|---|---|
| $L_1$ | 41 mm |
| $L_2$ | 7.5 mm |
| $L_5$ | 10.5 mm |
| $L_6$ | 5.0 mm |
| Distance between printed board and glass plate | 4.5 mm |
| Length of one side (horizontal width, vertical width) of square grounding conductor 10 | 60.0 × 60.0 mm |
| Width of gap between island-like conductor 19 and patch conductor 8 | 0.5 mm |

In this example, the cut-out portions were formed so that the radiated radio wave was a right-hand circularly polarized wave.

The patch conductor 8 and the island-shape conductor 19 were formed by printing silver paste on the glass plate and baking the printed paste. The upper casing 18 and the lower casing 20 were made of an ABS resin material. The lower casing 20 had a thickness of 3 mm. In order to bond the lower casing 20 to the glass plate which comprised a dielectric substrate, the lower casing 20 was affixed to the glass plate so as to surround the antenna element 6 by using, as the bonding portion 22, an acrylic form tape having a thickness of 0.8 mm (manufactured by 3M Corporation).

In order to insert the pillar-like conductor 7 in a portion of the printed board, a through hole was formed in the printed board so as to have substantially the same diameter as the outer diameter of the pillar-like conductor 7. A portion of the copper foil on the confronting substrate surface confronting the glass plate as the first dielectric substrate 1 was removed in a neighboring region around the through hole, and the copper foil on the substantially the entire region of the confronting substrate surface except for the neighboring region of the through hole was used as the grounding conductor 10. The transmission conductor 14, which comprised a microstrip line made of copper foil, was formed on the substrate surface of the printed board remote from the grounding conductor 10.

A spring probe, which had one end projecting to have contact with the island-like conductor 19 by a projecting length of 5 mm at the maximum, was used as the pillar-like conductor 7, the other end of the pillar-like conductor 7 was inserted into the through hole formed in the printed board to be connected to the transmission conductor 14 by soldering, and the pillar-like conductor 7 was fixed to the printed board. Additionally, the coaxial cable 16 for connection with the transmission conductor 14 was mounted to the printed board.

The printed board, on which the pillar-like conductor 7 was formed, and which had the transmission conductor 14 formed thereon and the coaxial cable 16 mounted thereto, was housed in the upper casing 18, being supported and fixed at a certain position. Under this situation, the upper casing 18 was engaged with and fixed to the lower casing 20 affixed to the glass plate, assembling the antenna device of Example 2. The distance between the grounding conductor 10 and the island-like conductor 19 at the time was set at 4.5 mm.

Figure 14:
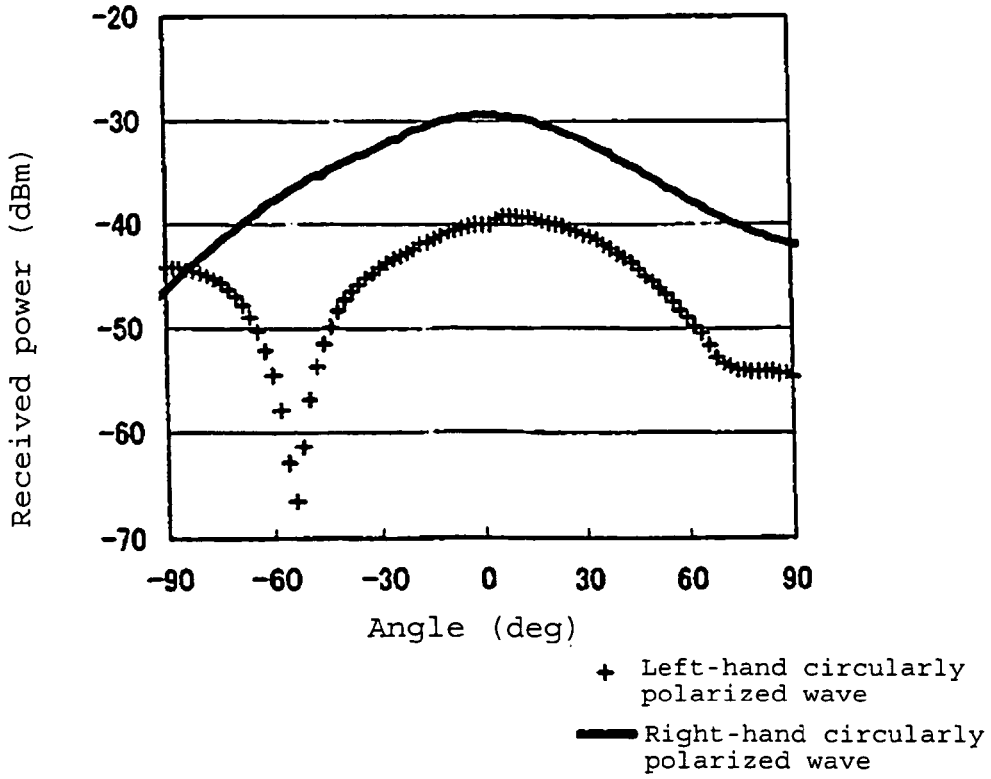
FIG. 14 is a graph showing a directivity of Example 2.

As seen from the return loss characteristic shown in FIG. 13, the antenna device of this example resonated at substantially 2.3 GHz and radiated a radio wave of substantially 2.3 GHz. Although the patch conductor was configured to cause the antenna device to serve as an antenna for a right-hand circularly polarized wave in this example, the radiated radio wave had a good directivity characteristic with respect to a right-hand circularly polarized wave as shown in FIG. 14, which proved that the antenna device of this example served as an antenna for a right-hand circularly polarized wave, having a good directivity characteristic.

Example 3

Figure 10:
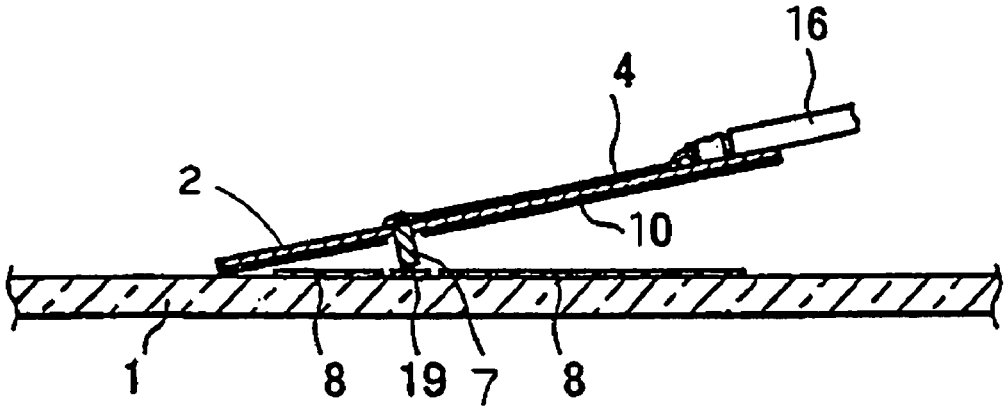
FIG. 10 is a cross-sectional view showing the antenna device of Example 3.
Figure 15:
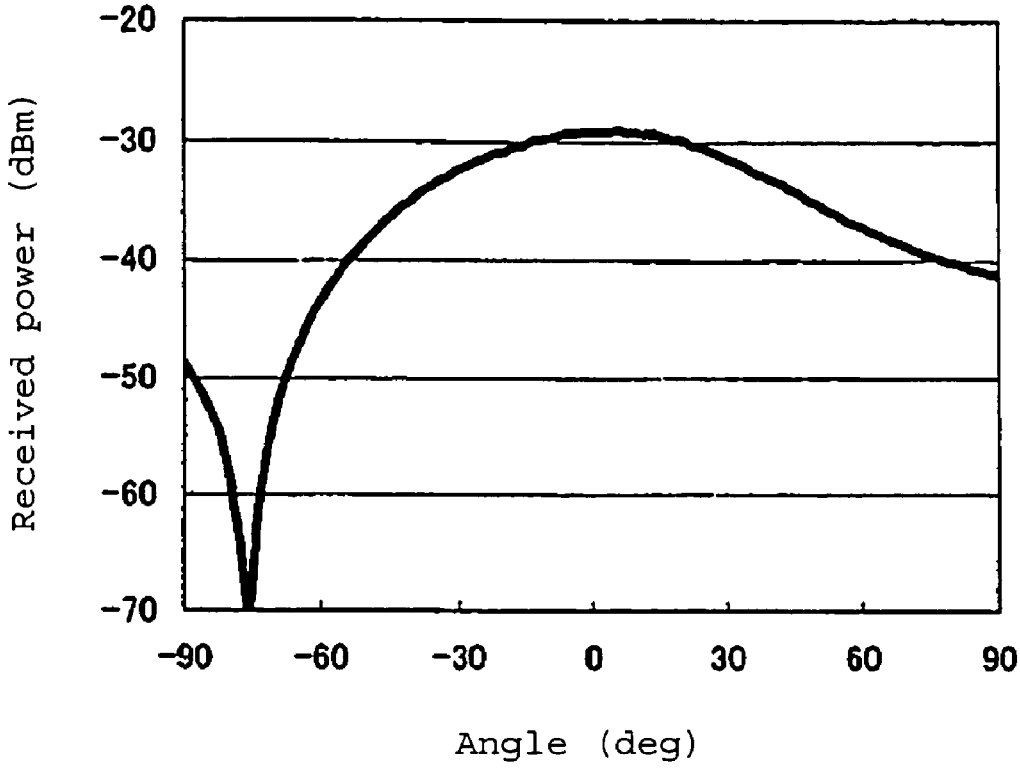
FIG. 15 is a graph showing a directivity of Example 3.

A glass plate and a printed board, which were similar to ones used in Example 2, were used to fabricate an antenna device constructed as shown in FIG. 10. The directivity, which was obtained when the printed board was held so as to be tilted against the glass plate, is shown in FIG. 15. As shown in FIG. 15, it is possible to adjust the directivity distribution in this way.

Example 4

Antenna devices were fabricated in the same way as Example 1 except for the glass plates having a thickness of 3.1 mm, the values stated below and the items listed in Table 2. In Table 2, the units of the distance, the gap and the length are mm. In each of the antenna devices, the dielectric substance between the glass plate and the printed board comprised air (having a dielectric constant of 1.0), and silicone having fluidity (having a dielectric constant of 2.7) or a mixture (having a dielectric constant of 4.0) with alumina powder (having a dielectric constant of 9 and a particle diameter of from 0.4 to 18 μm) mixed into silicone (having a dielectric constant of 2.7). In each of the antenna devices, the measured frequency was set at 2.338 GHz. In each of the antenna devices, the dimensions (length×width) of the glass plate were set at 200×200 mm.

Figure 16:
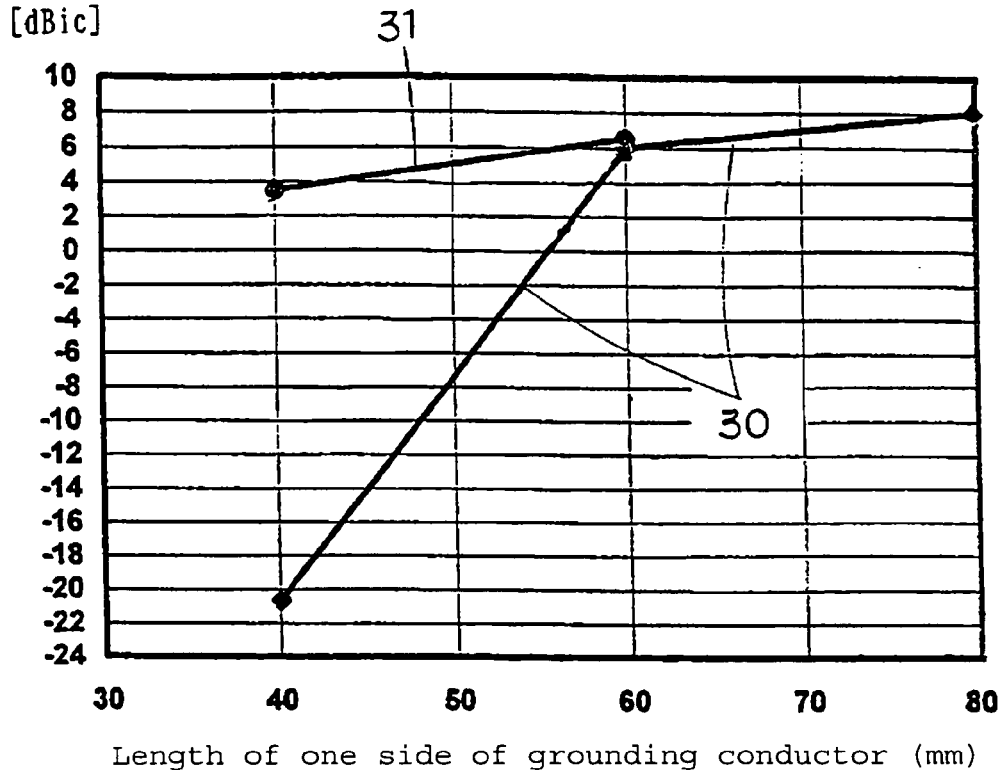
FIG. 16 is a characteristic graph, wherein the horizontal axis represents the length of one side (a horizontal width, a vertical width) of a square grounding conductor, and the vertical axis represents an antenna gain in Example 4.
Figure 17:
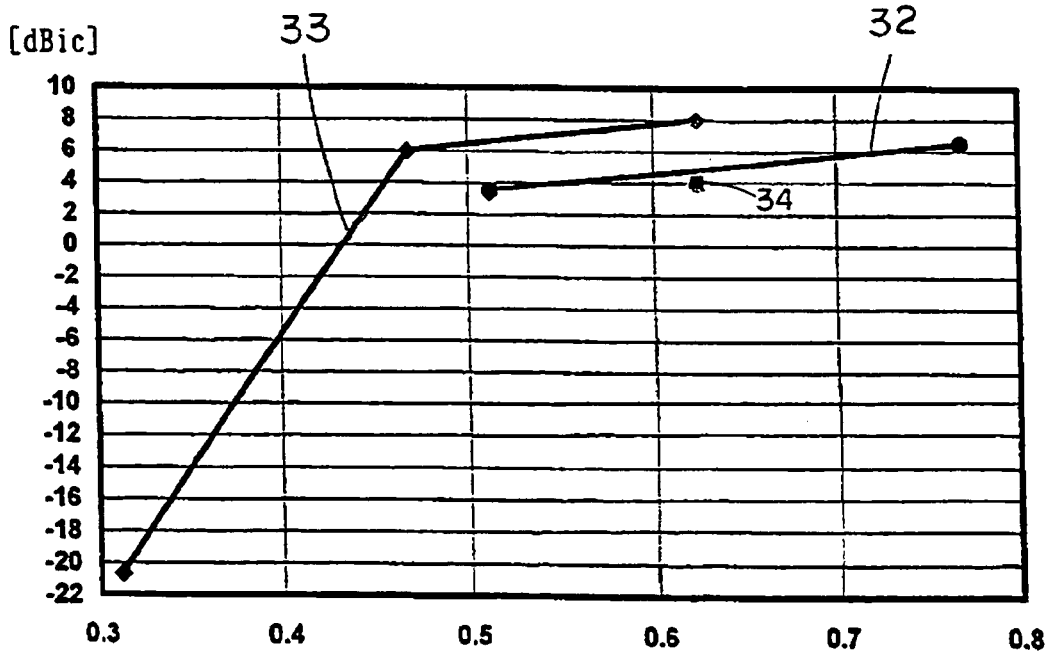
FIG. 17 is a characteristic graph, wherein the horizontal axis represents $L_g \times (\in_q)^{0.5} \div \lambda_0$, and the vertical axis represents an antenna gain in Example 4.

FIG. 16 shows characteristic curves, wherein the horizontal axis represents the length of one side (horizontal width, vertical width) of each square grounding conductors, and the vertical axis represents each antenna gain. Additionally, characteristic curves, wherein the horizontal axis represents the horizontal width or the vertical width $L_g$ of each grounding conductor that was normalized based on FIG. 16, i.e., the horizontal axis represents $L_g \times (\in_q)^{0.5} \div \lambda_0$, and the vertical axis represents each antenna gain, is shown in FIG. 17.

The characteristic curve 30 in FIG. 16 represents sample numbers 1 to 3 in Table 2, and the characteristic curve 31 in this figure represents sample numbers 4 and 5. In FIG. 16, sample number 6 is not shown. The characteristic curve 32 in FIG. 17 represents sample numbers 4 and 5 in Table 2, the characteristic curve 33 in this figure represents sample numbers 1 to 3, and a measurement point 34 represents sample number 6. When $L_3$ is a negative value in Table 2, it is meant that the first parallel portion 3*c* and the second parallel portion 3*d* overlap with the patch conductor 8 in a three-dimensional view, and that the first parallel portion 3*c* and the second parallel portion 3*d* are disposed inside the patch conductor 8 in a three-dimensional view. The dimensions of the lower casing 20 of sample number 6 were as follows.

| | |
|---|---|
| $W_1$ | 35.0 mm |
| $W_2$ | 42.0 mm |
| $W_3$ | 5.0 mm |

TABLE 2

| Sample number in Example 4 | Length of one side of grounding conductor | Dielectric constant of dielectric substance A | $L_1$ | $L_2$ | $L_3$ | $L_4$ | h | Gap between windowpane and printed board |
|---|---|---|---|---|---|---|---|---|
| 1 | 80 | 1.0 (air) | 38.0 | 7.9 | −1.3 | 17.0 | 1.2 | 6.8 |
| 2 | 60 | 1.0 (air) | 35.6 | 4.8 | 1.7 | 9.4 | 1.8 | 8.1 |
| 3 | 40 | 1.0 (air) | 39.9 | 19.0 | −1.3 | 5.2 | 0.5 | 9.9 |
| 4 | 60 | 2.7 | 31.1 | 6.9 | −2.2 | 9.9 | 0.5 | 4.4 |
| 5 | 40 | 2.7 | 31.4 | 8.5 | −2.2 | 9.8 | 1.7 | 7.1 |
| 6 | 40 | 4.0 | 25.0 | 7.7 | −1.3 | 7.9 | 0.7 | 7.3 |

Example 5

Figure 18:
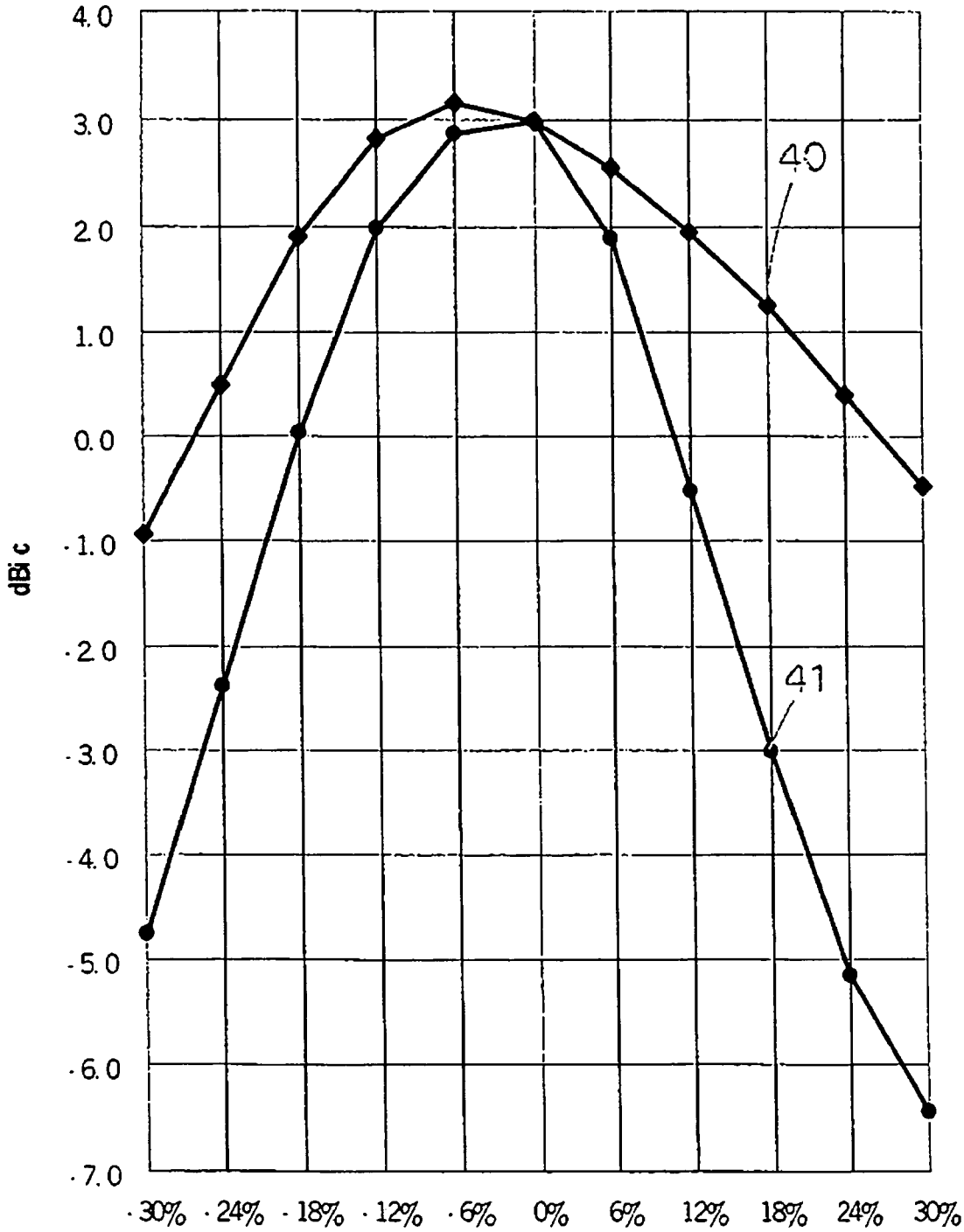
FIG. 18 is a graph showing the relationship between a dielectric constant of dielectric substance A and an antenna gain in Example 5.
Figure 19:
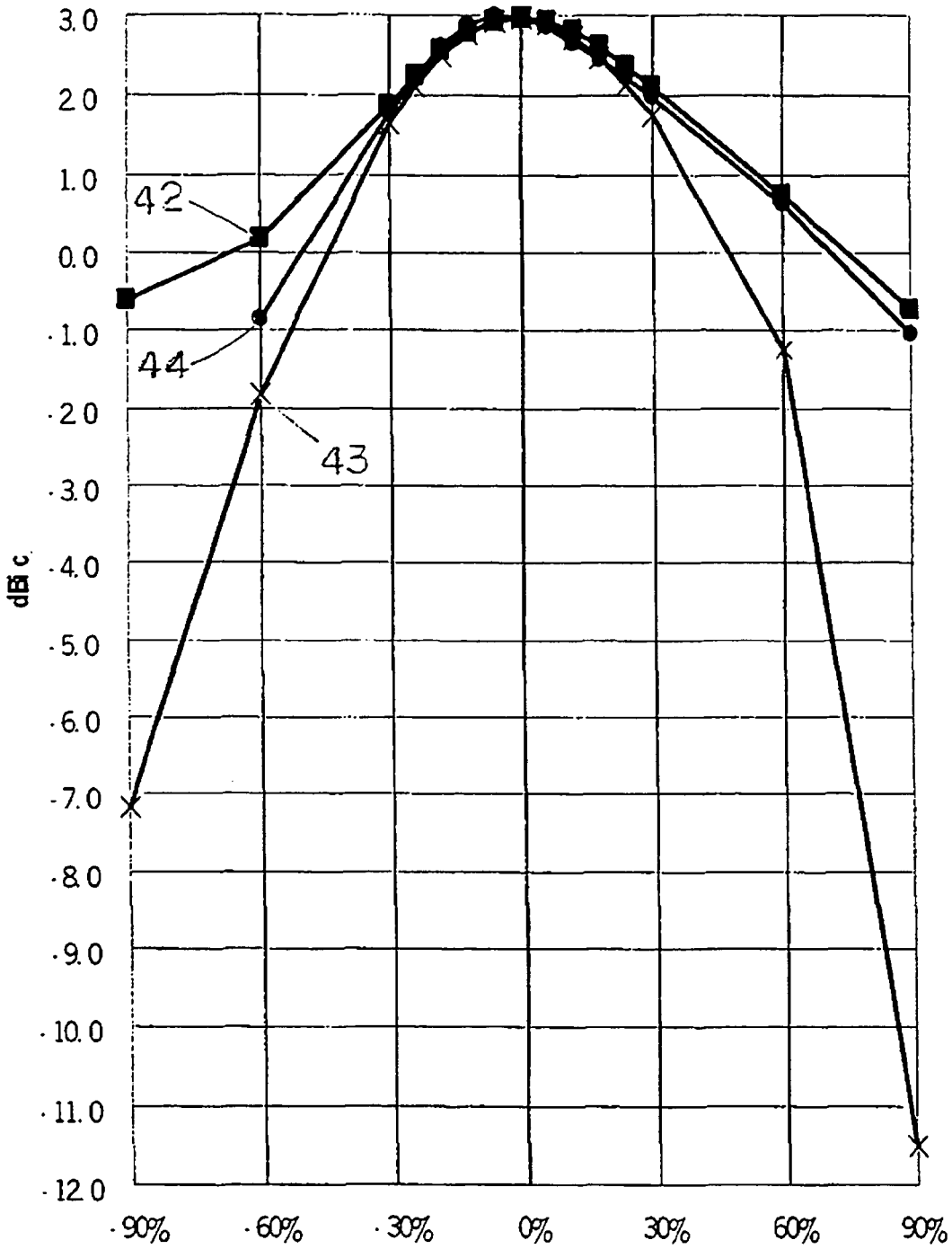
FIG. 19 is a graph showing the relationship among $L_2$, $L_4$ and the gap between the windowpane and the printed board in Example 5.

FIGS. 18 and 19 show the relationship between a rate of change in respective numerical values represented by the horizontal axis and an antenna gain represented by the vertical axis with respect to sample number 6 of Example 4. In FIG. 18, the dielectric constant of dielectric substance A (curve 40) and L (curve 41) are shown as the respective numerical values. In FIG. 19, $L_2$ (the curve 42), $L_4$ (curve 43) and the gap between the windowpane and the printed board (curve 44) are shown as the respective numerical values. FIGS. 18 and 19 are shown based on values calculated according to the moment method.

INDUSTRIAL APPLICABILITY

The antenna device according to the present invention includes the first dielectric substrate having the patch conductor, and the grounding conductor disposed so as to confront the patch conductor. As required, the antenna device includes the second dielectric substrate, which has the grounding conductor disposed on a substrate surface thereof confronting the patch conductor. When the conductor for electromagnetic coupling, which projects from the second dielectric substrate, is brought close to the patch conductor, the antenna device can be made smaller without degrading the transmission and reception power and the directivity since the conductor for electromagnetic coupling is connected to the patch conductor with respect to a high frequency.

Since the signal feeding means is not configured to be brought into contact with the patch conductor, it is not necessary to take the durability of the contacted portion into account, and it is possible to improve reliability. When the first dielectric substrate comprises a windowpane for a vehicle, it is possible to easily assemble the antenna device since the first dielectric substrate having the patch conductor is separated from the second dielectric substrate having the conductor for electromagnetic coupling or the pillar-like conductor.

When the first dielectric substrate comprises a windowpane for a vehicle, and when the patch conductor is disposed on an interior glass surface of the windowpane, the number of the interfaces of the dielectric member (through which a radio wave radiated from the patch conductor to external communication equipment passes, decreases in comparison with the conventional MSAs, and a decrease in the transmission power and the reception power caused by reflection of a radio wave (a decrease in gain) can be suppressed in comparison with the conventional antenna devices. Accordingly, it is possible to have better transmission power and better reception power in comparison with the conventional antenna device and to reduce the thickness of the antenna device, which has an advantage that a driver's sight is unlikely to be disturbed during driving. Since the grounding conductor is disposed on the second dielectric substrate confronting the windowpane, the antenna device has a directivity from the windowpane toward external communication equipment (outside the vehicle), increasing the transmission and the reception power in comparison with the conventional CPAs, which has the directivity in two directions of both sides of the substrate.

As stated earlier, the antenna device according to the present invention can be mounted to a vehicle and have excellent practicality by using, as the first dielectric substrate, a windowpane of the vehicle, such as a front windshield, or a backlite. Additionally, the antenna device can be configured so as to be appropriate for the GPS, the digital satellite broadcasting, the VICS, the ETC, and the DSRC system.

In other words, the present invention is applicable to the GPS, the digital satellite broadcasting, the VICS, the ETC, the DSRC system or the like for a vehicle.

The entire disclosures of Japanese Patent Application No. 2003-119944 filed on Apr. 24, 2003, Japanese Patent Application No. 2003-285224 filed on Aug. 1, 2003 and Japanese Patent Application No. 2004-065647 filed on Mar. 9, 2004 including specifications, claims, drawings and summaries are incorporated herein by reference in their entireties.

What is claimed is:

1. An antenna device comprising:

a first dielectric substrate having a patch conductor disposed thereon, the patch conductor having a vertical width of $L_1$ and a horizontal width of $L_1$; and a second dielectric substrate confronting the first dielectric substrate and having a grounding conductor disposed on a substrate surface confronting the patch conductor;

wherein the second dielectric substrate is disposed on a spacer disposed on the first dielectric substrate and the second dielectric substrate and the first dielectric substrate are separated from each other by a distance by the spacer to form a space interposed between the second dielectric substrate and the first dielectric substrate;

wherein a dielectric substance that is not air or air is interposed in the space between the first dielectric substrate and the second dielectric substrate when a radio wave to be used for communication has a frequency of from 2.10 to 2.65 GHz;

wherein when the dielectric substance that is not air is interposed in the space between the first dielectric substrate and the second dielectric substrate, the dielectric substance has a dielectric constant of from 1.89 to 5.20 and $L_1$ is from 21.3 to 36.11 mm; and wherein when air is interposed between the first dielectric substrate and the second dielectric substrate, $L_1$ is from 32.68 to 41.80 mm.

2. The antenna device according to claim 1, wherein the spacer is disposed on the first dielectric substrate so as to serve as part of a lower casing;

wherein the spacer includes a first fixing means;

wherein an upper casing is disposed;

wherein the upper casing includes a second fixing means; and wherein the upper casing is mounted to the spacer so as to cover the second dielectric substrate by fixing the second fixing means to the first fixing means.

3. The antenna device according to claim 1, wherein at least one of the spacer and the second dielectric substrate has a hole formed therein for introduction of the dielectric substance having fluidity.

4. The antenna device according to claim 1, wherein a conductor for electromagnetic coupling is disposed so as to extend toward the first dielectric substrate from a confronting surface of the second dielectric substrate confronting the first dielectric substrate;

the conductor for electromagnetic coupling and the grounding conductor are configured so as not to be connected together with respect to a direct current; and the conductor for electromagnetic coupling and the patch conductor are electromagnetically connected together.

5. The antenna device according to claim 4, wherein the conductor for electromagnetic coupling has a portion parallel or substantially parallel with the patch conductor.

6. The antenna device according to claim 5, wherein a dielectric substance is interposed between the first dielectric substrate and the second dielectric substrate, the dielectric substance has a dielectric constant of from 1.89 to 5.20, the conductor for electromagnetic coupling has a portion parallel or substantially parallel with the patch conductor, and the portion of the conductor for electromagnetic coupling parallel or substantially parallel with the patch conductor has a length of from 8.7 to 28.7 mm.

7. The antenna device according to claim 4, wherein the conductor for electromagnetic coupling extends from the second dielectric substrate toward the first dielectric substrate, the conductor for electromagnetic coupling is bent before reaching a surface of the first dielectric substrate close to the second dielectric substrate, and the conductor for electromagnetic coupling extends parallel or substantially parallel with the patch conductor.

8. The antenna device according to claim 4, wherein the grounding conductor is disposed on a confronting substrate surface of the second dielectric substrate confronting the patch conductor;

wherein a transmission conductor is disposed on a substrate surface of the second dielectric substrate remote from the patch conductor; and wherein the conductor for electromagnetic coupling passes through the second dielectric substrate in a thickness direction of the second dielectric substrate and is connected to the transmission conductor.

9. The antenna device according to claim 4, wherein the grounding conductor is disposed on a substrate surface of the second dielectric substrate remote from the patch conductor, and the substrate surface of the second dielectric substrate remote from the patch conductor has a slot without the grounding conductor disposed therein;

wherein a transmission conductor is disposed at a central or substantially central portion of the slot so as not to be connected to the grounding conducting with respect to a direct current; and wherein the conductor for electromagnetic coupling passes through the second dielectric substrate in a thickness direction of the second dielectric substrate and is connected to the transmission conductor.

10. The antenna device according to claim 4, wherein when $L_1$ is from 21.5 to 34.85 mm, the grounding conductor has an area of from 1,024 to 2,304 $mm^2$, the conductor for electromagnetic coupling has a portion parallel or substantially parallel with the patch conductor, and the portion of the conductor for electromagnetic coupling parallel or substantially parallel with the patch conductor has length of from 7.9 to 29.4 mm.

11. The antenna device according to claim 4, wherein the conductor for electromagnetic coupling has a portion parallel or substantially parallel with the patch conductor; and wherein in a case where air is interposed in the space between the first dielectric substrate and the second dielectric substrate, the portion of the conductor for electromagnetic coupling parallel or substantially parallel with the patch conductor has a length of from 10.4 to 27.3 mm.

12. The antenna device according to claim 11, wherein the grounding conductor has an area of from 3,240 to 3,960 $mm^2$.

13. The antenna device according to claim 4, wherein the conductor for electromagnetic coupling has a portion parallel of substantially parallel with the patch conductor, the portion of the conductor for electromagnetic coupling parallel or substantially parallel with the patch conductor three-dimensionally overlaps with the patch conductor, and the portion is three-dimensionally disposed inside the patch conductor, and an axial center of the portion and a peripheral edge of the patch conductor have a gap of from 1.17 to 2.42 mm therebetween in a three-dimensional view.

14. The antenna device according to claim 4, wherein when air is interposed in the space between the first dielectric substrate and the second dielectric substrate, the conductor for electromagnetic coupling has a portion parallel or substantially parallel with the patch conductor, and the portion of the conductor for electromagnetic coupling parallel or substantially parallel with the patch conductor has a length of from 4.7 to 49.3 mm.

15. The antenna device according to claim 14, wherein the conductor for electromagnetic coupling has a Young's modulus of $5\times10^{10}$ Pa or above, and the conductor for electromagnetic coupling has a cross-sectional area of from 0.16 to 16 $mm^2$.

16. The antenna device according to claim 1, further comprising an antenna element including the patch conductor disposed on the first dielectric substrate; and a pillar-like conductor, which is insulated from the grounding with respect to a direct current, which projects toward the first dielectric substrate from a substrate surface of the second dielectric substrate confronting the first dielectric substrate, and which is electrically connected, as a signal line, to the patch conductor disposed on the first dielectric substrate.

17. The antenna device according to claim 16, wherein the grounding conductor is disposed on a confronting substrate surface of the second dielectric substrate confronting the patch conductor;

wherein a transmission conductor is disposed on a substrate surface of the second dielectric substrate remote from the patch conductor;

wherein the pillar-like conductor passes through the second dielectric substrate in a thickness direction of the second dielectric substrate and is connected to the transmission conductor.

18. The antenna device according to claim 16, wherein the grounding conductor is disposed on a substrate surface of the second dielectric substrate remote from the patch conductor, and the substrate surface of the second dielectric substrate remote from the patch conductor has a slot without the grounding conductor disposed therein;

wherein a transmission conductor is disposed at a central or substantially central portion of the slot so as not to be connected to the grounding conductor with respect to a direct current; and wherein the pillar-like conductor passes through the second dielectric substrate in a thickness direction of the second dielectric substrate and is connected to the transmission conductor.

19. The antenna device according to claim 16, wherein the antenna element disposed on the first dielectric substrate includes an island-like conductor in addition to the patch conductor, the island-like conductor being apart from the patch conductor and being surrounded by the patch conductor, and wherein the island-like conductor is connected to the pillar-like conductor.

20. The antenna device according to claim 16, wherein the pillar-like conductor comprises a spring probe.

21. The antenna device according to claim 20, wherein the spring probe has a repulsive force of from 0.2 to 5.0 N.

22. The antenna device according to claim 1, wherein in a case wherein the radio wave to be used for communication has a wavelength of $\lambda_0$ in air, wherein the dielectric substance is interposed between the first dielectric substrate and the second dielectric substrate, wherein the dielectric substance has a dielectric constant of $\in_r$, and wherein the grounding conductor has an area of S, when the grounding conductor has a normalized width $W_g$ represented by $(S)^{0.5}\times(\in_r)^{0.5}/\lambda_0$, the formula of $0.42\leqq W_g\leqq 0.81$ is established.

23. The antenna device according to claim 1, wherein a distance between the patch conductor and the grounding conductor is from 3.6 to 10.8 mm.

24. The antenna device according to claim 1, wherein the first dielectric substrate comprises a windowpane for a vehicle, wherein the grounding conductor has an area of from 1,024 to 2,304 $mm^2$, and wherein the spacer is bonded to the windowpane so as to surround the patch conductor, and a bonding portion where the spacer is bonded to the windowpane has an area of from 150 to 770 $mm^2$.

25. The antenna device according to claim 24, wherein the bonding portion where the spacer is bonded to the windowpane has a bonding strength of 0.4 $N/mm^2$ or above.

26. The antenna device according to claim 24, wherein the spacer is bonded to the windowpane through the bonding portion, and wherein the bonding portion has a thickness of from 0.4 to 3.0 mm.

27. The antenna device according to claim 1, wherein a portion of the grounding conductor is disposed between the spacer and the second dielectric substrate, and wherein the spacer has a dielectric constant of from 1.89 to 12.0.

28. The antenna device according to claim 1, wherein the patch conductor is formed in a square shape or a substantially square shape; and wherein the patch conductor has cut-out portions formed in a rectangular equilateral triangle or a substantially rectangular equilateral triangle at a corner and the opposite corner thereof, and imaginary sides having a right angle included therebetween in each of the cut-out portions have a length of from 0.77 to 16.7 mm.

29. A method for fabricating the antenna device defined in claim 1, comprising the steps of (1) to (5) below:

(1) preparing a windowpane as the first dielectric substrate, the windowpane being fitted into an opening of a vehicle and having the patch conductor disposed thereon, or preparing a windowpane as the first dielectric substrate, the windowpane being not fitted into an opening of a vehicle but having the patch conductor disposed thereon;

(2) disposing a bonding portion on the windowpane or disposing a bonding portion on a surface of the spacer close to the windowpane;

(3) affixing the spacer at a position on the windowpane so that the spacer is bonded to the windowpane through the bonding portion;

(4) disposing a dielectric substance on a substrate surface of the second dielectric substrate close to the windowpane, followed by fixing the second dielectric substrate to the spacer after; and (5) fitting the windowpane into the opening when using in step (1) the windowpane that is not fitted into the opening.

30. The method according to claim 29, comprising, instead of step (4), a step for affixing the spacer to the windowpane, followed by disposing a dielectric substance on the patch conductor and by fixing the second dielectric substrate to the spacer.

31. The method according to claim 29, comprising, instead of step (4), a step for fixing the second dielectric substrate to the spacer, followed by introducing a dielectric substrate, through a hole formed in the spacer or the second dielectric substrate, into a gap surrounded by the windowpane and the second dielectric substrate, the dielectric substance having fluidity.

32. The method according to claim 29, further comprising in step (4) or the step in exchange for step (4):

providing the spacer with a first fixing means, and preparing an upper casing having a second fixing means formed therein; and fixing the second fixing means to the first fixing means so that the second dielectric substrate is sandwiched between the spacer and the upper casing and that the upper casing is mounted to the spacer so as to cover the second dielectric substrate.

33. The method according to claim 29, further comprising in step (4) or the step in exchange for step (4):

providing the spacer with a first fixing means, and preparing an upper casing having a second fixing means and having the second dielectric substrate disposed therein; and fixing the second fixing means to the first fixing means so that the upper casing is mounted to the spacer.

34. The method according to claim 29, further comprising in step (4) or the step in exchange for step (4):

providing the second dielectric substrate with a conductor for electromagnetic coupling or a pillar-line conductor.

35. The method according to claim 29, further comprising in step (4):

using the dielectric substance having fluidity; and disposing a molding frame on the second dielectric substrate when disposing the dielectric substance on the grounding conductor on the second dielectric substrate, and introducing the dielectric substance into the molding frame, followed by removing the molding frame after causing the dielectric substance to lose the fluidity or to slightly lose the fluidity and by fixing the second dielectric substrate to the spacer.

36. A method for fabricating the antenna device defined in claim 1, comprising the steps of (1) to (5) below:

(1) preparing a windowpane as the first dielectric substrate, the windowpane being fitted into an opening of a vehicle and having the patch conductor disposed thereon, or preparing a windowpane as the first dielectric substrate, the windowpane being not fitted into an opening of a vehicle but having the patch conductor disposed thereon;

(2) disposing a bonding portion on the windowpane or disposing a bonding portion on a surface of the spacer close to the windowpane;

(3) fixing the second dielectric substrate to the spacer;

(4) disposing a dielectric substance on a substrate surface of the second dielectric substrate close to the windowpane, followed by affixing the spacer at a position on the windowpane so as to bond the spacer to the windowpane through the bonding portion; and (5) fitting the windowpane into the opening when using in step (1) the windowpane that is not fitted into the opening.

37. The method according to claim 36, comprising, instead of step (4), a step for disposing a dielectric substance on the patch conductor on the windowpane, followed by fixing the spacer to the windowpane.

38. The method according to claim 37, further comprising in a step in exchange for step (4):

using the dielectric substance having fluidity; and disposing a molding frame on the windowpane when disposing the dielectric substance on the patch conductor on the windowpane, and introducing the dielectric substance into the molding frame, followed by removing the molding frame after causing the dielectric substance to lose the fluidity or to slightly lose the fluidity and by affixing the spacer at a position on the windowpane.

39. The method according to claim 36, instead of step (4), comprising a step for fixing the spacer to the windowpane, followed by introducing a dielectric substrate, through a hole formed in the spacer or the second dielectric substrate, into a gap surrounded by the windowpane and the second dielectric substrate, the dielectric substance having fluidity.

40. The method according to claim 36, further comprising, instead of step (3):

Providing the spacer with a first fixing means, and preparing an upper casing having a second fixing means; and fixing the second fixing means to the first fixing means so that the second dielectric substrate is sandwiched between the spacer and the upper casing and that the upper casing is mounted to the spacer so as to cover the second dielectric substrate.

41. The method according to claim 36, comprising, instead of step (3):

providing the spacer with a first fixing means, and preparing an upper casing having a second fixing means formed therein and having the second dielectric substrate disposed therein; and fixing the second fixing means to the first fixing means so that the upper casing is mounted to the spacer.

42. The method according to claim 36, further comprising in step (3) or the step in exchange for step (4):

mounting a conductor for electromagnetic coupling or a pillar-like conductor before fixing the second dielectric substrate to the spacer or after fixing the second dielectric substrate to the spacer.

43. The method according to claim 36, wherein the spacer and the upper casing are integrally formed.

44. The antenna device according to claim 1, wherein the first dielectric substrate and the second dielectric substrate have a mixed dielectric substance interposed therebetween, the mixed dielectric substance comprising dielectric substance A and dielectric substance M mixed together therein, dielectric substance M having a different dielectric constant from dielectric substance A, and the mixed dielectric substance having a dielectric constant determined according to an area of the grounding conductor.

45. An antenna device having a microstrip antenna, comprising a patch conductor, a second dielectric substrate and a grounding conductor, the patch conductor being disposed on an interior surface of a windowpane for a vehicle as a first dielectric substrate or on a dielectric film disposed on an interior surface of a windowpane for a vehicle as a first dielectric substance, the second dielectric substrate being disposed so as to be apart from the windowpane by a distance so as to confront the patch conductor, and the grounding conductor being disposed on the second dielectric substrate;

wherein when a radio wave to be used in communication has a wavelength of $\lambda_0$ in air, and when a shortest distance between the patch conductor and an edge of an opening of a vehicle body is D, the formula of $0.01 \leqq D/\lambda_0$ is established; and wherein a shortest distance between a portion of the antenna device farthest from the edge of the opening of the vehicle body and the edge of the opening of the vehicle body is 200 mm or below.

46. The antenna device according to claim 45, wherein the second dielectric substrate and the first dielectric substrate are separated from each other by the distance by at least one of a spacer, an insulating sheet and an insulating substrate interposed between the second dielectric substrate and the fist dielectric substrate.

47. The antenna device according to claim 45, wherein at least one selected among air, a single dielectric substance except for air and a combination of plural kinds of dielectric substances is interposed between the first dielectric substrate and the second dielectric substrate.

48. The antenna device according to claim 47, wherein when the dielectric substance comprises substance A, substance A has fluidity or semi-fluidity, or has fluidity or semi-fluidity at at least an initial stage, and substance A has a curable property or a semi-curable property with lapse of time or by being subjected to treatment.

49. The antenna device according to claim 48, wherein dielectric substance M is mixed into substance A, dielectric substance M containing powder having a larger dielectric constant than substance A.

50. The antenna device according to claim 49, wherein dielectric substance M has a particle size of from 0.1 to 50 μm.

51. The antenna device according to claim 48, wherein in a gap having the distance between the first dielectric substrate and the second dielectric substrate, cured dielectric substance B is disposed on a side of the second dielectric substrate, and dielectric substance A is disposed on a side of the first dielectric substrate;

wherein dielectric substance A has fluidity or semi-fluidity, or has fluidity or semi-fluidity at at least an initial stage, and dielectric substance A has a curable property or a semi-curable property with lapse of time or by being subjected to treatment; and wherein a portion of the conductor for electromagnetic coupling is embedded in dielectric substance B, or a portion of the conductor for electromagnetic coupling is brought into contact with dielectric substance B.

52. The antenna device according to claim 51, wherein in a case wherein dielectric substance A and dielectric substance B are interposed between the first dielectric substrate and the second dielectric substrate, wherein dielectric substance A has a dielectric constant of $\in_A$, and wherein dielectric substance B has a dielectric constant of $\in_B$; when ($\in_A \cdot \in_B \cdot$(thickness of dielectric substance A+thickness of dielectric substance B))/($\in_B \cdot$thickness of dielectric substance A+$\in_A \cdot$thickness of dielectric substance B) is represented by $\in_q$, and when the grounding conductor has a normalized width $W_g$ represented by $(S)^{0.5} x (\in_q)^{0.5}/\lambda_0$, the formula of $0.42 \leqq W_g \leqq 0.81$ is established.

53. The antenna device according to claim 51, wherein in case wherein a radio wave to be used for communication has a frequency of from 2.10 to 2.65 GHz, wherein dielectric substance A and dielectric substance B are interposed between the first dielectric substrate and the second dielectric substrate, wherein dielectric substance A has a dielectric constant of $\in_A$, and wherein dielectric substance B has dielectric constant of $\in_B$, when ($\in_A \cdot \in_B \cdot$(thickness of dielectric substance A+thickness of dielectric substance B))/($\in_B \cdot$thickness of dielectric substance A+$\in_A \cdot$thickness of dielectric substance B) is represented by $\in_q$, $\in_q$ is from 1.89 to 5.80, and the grounding conductor has an area of from 1,024 to 3,960 $mm^2$.

54. The antenna device according to claim 45, wherein when a radio wave used in communication has a frequency of from 2.10 to 2.65 GHz, a dielectric substance is interposed between the first dielectric substrate and the second dielectric substrate, and the dielectric substance has a dielectric constant of from 1.89 to 5.80, and the grounding conductor has an area of from 1,024 to 3,960 $mm^2$.

55. The antenna device according to claim 45, wherein in a case where a radio wave to be used for communication has a frequency of from 2.10 to 2.65 GHz, and where a dielectric substance is interposed between the first dielectric substrate and the second dielectric substrate, when the dielectric substance has a dielectric constant of from 1.89 to 5.20, and when the patch conductor has a vertical width of $L_1$ and a horizontal width of $L_1$, $L_1$ is from 21.3 to 36.11 mm; and wherein in a case air is interposed between the first dielectric substance and the second dielectric substance, $L_1$ is from 32.68 to 41.80 mm.

56. The antenna device according to claim 45, wherein the second dielectric substrate is disposed on a spacer disposed on the windowpane, and the second dielectric substrate and the windowpane are separated from each other by a distance determined by the spacer;

wherein when a dielectric substance is interposed between the windowpane and the second dielectric substrate, and when the dielectric substance has a dielectric constant of from 2.56 to 5.80, the spacer is disposed on the windowpane so as to depict four sides of a square or four sides of a substantially square in a band shape, and the spacer has an outer peripheral edge width of from 33 to 50 mm.

57. The antenna device according to claim 45, wherein when a radio wave to be used for communication has a frequency of from 2.10 to 2.65 GHz, the grounding conductor has an area of from 1,024 to 2,304 $mm^2$, and wherein when the patch conductor has a vertical width of $L_1$ and horizontal width of $L_1$, $L_1$ is from 19.0 to 29.0 mm, and wherein at least one selected among air, a single sort of dielectric substance except for air, and a combination of plural sorts of dielectric substances is interposed between the patch conductor and the grounding conductor, and the single sort of dielectric substance has a dielectric constant of from 2.56 to 5.80, or at least one dielectric substance in the combination has a dielectric constant of from 2.56 to 5.80.

58. The antenna device according to claim 45, wherein when a radio wave to be used for communication has a frequency of from 2.10 to 2.65 GHz, the grounding conductor has an area of from 1,024 to 2,304 $mm^2$, and wherein when the patch conductor has a vertical width of $L_1$ and a horizontal width of $L_1$, $L_1$ is from 19.0 to 29.0 mm, and wherein at least one selected among air, a single sort of dielectric substance except for air, and a combination of plural sorts of dielectric substances is interposed between the patch conductor and the grounding conductor to form a dielectric inclusion, and the dielectric inclusion has a dielectric constant of from 2.56 to 5.80.

59. An antenna device having a microstrip antenna, comprising a patch conductor, an insulating sheet or insulating substrate and a grounding conductor, the patch conductor being disposed on an interior surface of a windowpane for a vehicle as a first dielectric substrate or on a dielectric film disposed on an interior surface of a windowpane for a vehicle as a first dielectric substrate, the insulating sheet or insulating substrate being disposed on the windowpane so as to confront the patch conductor, and the grounding conductor being disposed on the insulating sheet or insulating substrate;

wherein when a radio wave to be used in communication has a wavelength of $\lambda_0$ in air, and when a shortest distance between the patch conductor and an edge of an opening of a vehicle body is D, the formula of $0.01 \leqq D/\lambda_0$ is established; and wherein a shortest distance between a portion of the antenna device farthest from the edge of the opening of the vehicle body is 200 mm or below.

60. The antenna device according to claim 59, wherein when the insulating sheet or insulating substrate is called an insulating supporting means, a second dielectric substrate is disposed on a side of the insulating supporting means remote from the windowpane, and the grounding conductor is interposed between the insulating supporting means and the second dielectric substrate, or the grounding conductor is disposed on the second dielectric substrate in exchange for the grounding conductor being disposed on the insulating supporting means.

61. The antenna device according to claim 59, wherein when a radio wave to be used for communication has a frequency of from 2.10 to 2.65 GHz, the grounding conductor has an area of from 1,0234 to 2,304 $mm^2$, and wherein when the patch conductor has a first width of $L_1$ and second width of $L_1$, $L_1$ is from 19.0 to 29.0 mm, and wherein the insulating sheet or insulating substrate has a dielectric constant of from 2.56 to 5.80.

62. The antenna device according to claim 61, wherein at least one selected among air, a single sort of dielectric substance except for air, and a combination of plural sorts of dielectric substances in addition to the insulating sheet or insulating substrate is interposed between the patch conductor and the grounding conductor; and wherein the single sort of dielectric substance has a dielectric constant of from 2.56 to 5.80, or at least one dielectric substance in the combination has a dielectric constant of from 2.56 to 5.80.

63. The antenna device according to claim 59, wherein when the insulating sheet or insulating substrate is called an insulating supporting means, at least one selected among air, a single sort of dielectric substance except for air, and a combination of plural sorts of dielectric substances in additional to the insulating supporting means is interposed between the patch conductor and the grounding conductor to form a dielectric inclusion; and at least one portion of the dielectric inclusion has a dielectric constant of from 2.56 to 5.80.

64. The antenna device according to claim 63, wherein the dielectric constant of the dielectric inclusion is an average value of the dielectric constants of the respective substances forming the dielectric inclusion.

65. The antenna device according to claim 59, wherein a distance between the patch conductor and the grounding conductor is from 2.92 to 15.3 mm.

66. The antenna device according to claim 59, wherein a conductor for electromagnetic coupling is partly or entirely disposed between the patch conductor and the grounding conductor, and the patch conductor and the grounding conductor are electromagnetically coupled with each other to feed power.

67. The antenna device according to claim 66, wherein when a radio wave to be used for communication has a frequency of from 2.10 to 2.65 GHz, the grounding conductor has an area of from 1,0243 to 2,304 $mm^2$;

wherein when the patch conductor has a vertical width of $L_1$ and a horizontal width of $L_1$, $L_1$ from 19.0 to 29.0 mm;

wherein at least one selected among the dielectric substance, the insulating sheet and the insulating substrate interposed between the patch conductor and the grounding conductor has a dielectric constant of from 2.5 to 5.80; and wherein the conductor for electromagnetic coupling has a portion parallel or substantially parallel with the patch conductor, and the portion of the conductor for electromagnetic coupling parallel or substantially parallel with the patch conductor has a length of from 3.95 to 28.7 mm.

* * * * *